US007268496B2

(12) United States Patent
Takahashi et al.

(10) Patent No.: US 7,268,496 B2
(45) Date of Patent: Sep. 11, 2007

(54) DISCHARGE LAMP LIGHTING DEVICE AND LIGHTING SYSTEM

(75) Inventors: Yuuji Takahashi, Sagamihara (JP); Kazutoshi Mita, Yokohama (JP); Masahiko Kamata, Yokohama (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 11/311,373

(22) Filed: Dec. 20, 2005

(65) Prior Publication Data

US 2006/0132044 A1 Jun. 22, 2006

(30) Foreign Application Priority Data

Dec. 20, 2004 (JP) ..... 2004-368076

(51) Int. Cl.
*H05B 37/02* (2006.01)

(52) U.S. Cl. ..... 315/105; 315/106; 315/107

(58) Field of Classification Search ..... 315/224, 315/105, 106, 107, 307
See application file for complete search history.

(56) References Cited

U.S. PATENT DOCUMENTS 6,552,494 B2 * 4/2003 Randazzo et al. ..... 315/106
7,061,188 B1 * 6/2006 Katyl et al. ..... 315/291

* cited by examiner

*Primary Examiner*—David Vu
(74) *Attorney, Agent, or Firm*—DLA Piper US LLP

(57) ABSTRACT

When a discharge lamp is preheated, impedance of a filament electrode of the discharge lamp is computed. In accordance with the computed impedance, preheating and lighting of the discharge lamp are controlled.

16 Claims, 20 Drawing Sheets

DISCHARGE LAMP LIGHTING DEVICE AND LIGHTING SYSTEM

CROSS-REFERENCE TO RELATED APPLICATIONS

This application is based upon and claims the benefit of priority from prior Japanese Patent Application No. 2004-368076, filed Dec. 20, 2004, the entire contents of which are incorporated herein by reference.

BACKGROUND OF THE INVENTION

1. Field of the Invention

The present invention relates to a discharge lamp lighting device and a lighting system, which lights a discharge lamp.

2. Description of the Related Art

A discharge lamp has two filament electrodes and is lighted by high-frequency voltage which is applied across these filament electrodes.

In order to light this discharge lamp, a discharge lamp lighting device allows preheat current to flow in the discharge lamp in advance to preheat the discharge lamp, and after this preheating, high-frequency voltage of a predetermined level for starting is applied across each filament electrode of the discharge lamp to light the discharge lamp.

The time required for preheating the discharge lamp varies in accord with differences of characteristics of filament electrodes in the discharge lamp.

BRIEF SUMMARY OF THE INVENTION

It is an object of one embodiment of the present invention is to provide a discharge lamp lighting device and a lighting system which can reduce variations of time required to preheat a discharge lamp.

According to one aspect of the present invention, there is provided a discharge lamp lighting device, comprising:

a high-frequency generating circuit which outputs high-frequency voltage;

a discharge lamp having a pair of filament electrodes, the discharge lamp being lighted by the high-frequency voltage applied across the filament electrodes;

a current detector detecting preheat current which flows the filament electrodes of the discharge lamp;

a voltage detector which detects voltage generated in either one filament electrode of the pair of filament electrodes; and a controller which computes impedance of either one of the filament electrodes from the preheat current detected by the current detector and the detecting voltage of the voltage detector, and controls to preheat and light the discharge lamp in accordance with the computed impedance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

[1] Description will be made on a first embodiment of the present invention

Figure 1:
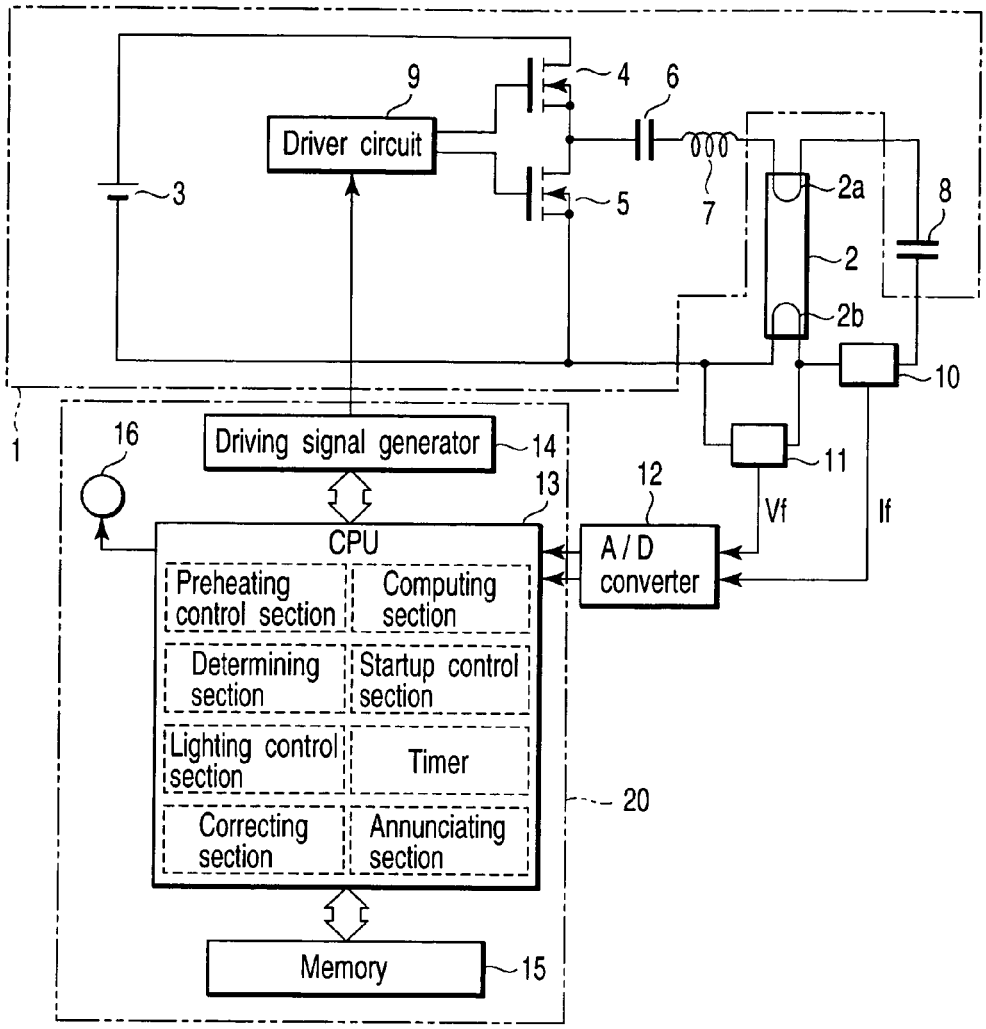
FIG. 1 shows a configuration of a first embodiment.

As shown in FIG. 1, a discharge lamp 2 is connected to a high-frequency generating circuit (also called a switching circuit).

The high-frequency generating circuit 1 comprises a direct current power supply 3, a resonance circuit comprising a resonance capacitor 6 and a resonance coil 7 connected to the DC power supply, two switching elements that energize this resonance circuit, for example, FETs (field effect transistor) 4, 5, and a driver circuit 9 that turns ON and OFF this FET alternately, and a preheating capacitor 8, and the high-frequency generating circuit 1 generates the high-frequency voltage by turning ON and OFF the switching elements 4, 5 alternately. That is, series circuits of FETs 4, 5 are connected to the DC power supply 3, and one end of the filament electrode 2*a* of the discharge lamp 2 is connected to the connections between the source of the FET 4 and the drain of the FET 5 via the resonance circuit comprising the resonance capacitor 6 and resonance coil 7. Further, the filament electrodes 2*b* of the discharge 2 is connected to the source of the FET 5. Furthermore, the preheating capacitor 8 for allowing preheat current to flow is connected between the other end of the filament electrode 2*a* of the discharge lamp 2 and the other end of the filament electrode 2*b*.

The discharge lamp 2 has a pair of filament electrodes 2*a*, 2*b*, and is lighted by the output voltage (high-frequency voltage) of the high-frequency generating circuit 1 applied across these filament electrodes 2*a*, 2*b*.

The preheat current If that flows in filament electrodes 2*a*, 2*b* of the discharge lamp is detected by a current detector 10 such as a current transformer, etc. In addition, the voltage Vf generated in the filament electrode 2*b* of the discharge lamp 2 is detected by a voltage detector. Preheat current If detected by the current detector 10 and detecting voltage Vf of a voltage detector 11 are converted into digital signals by an A/D converter, respectively, and supplied to a CPU 13 of a controller 20. The A/D converter 12 converts and outputs, for example, inputted analog values into digital values by sampling and quantizing them.

The controller 20 computes the impedance Rh of the filament electrode 2*b* of the discharge lamp 2 from the preheat current detected by the current detector 10 and the detecting voltage of the voltage detector 11, and controls heating and lighting of the discharge lamp 2 in accordance with the computed impedance Rh. The controller 20 comprises the CPU 13, a driving signal generator 14, a memory 15, and a trouble annunciation lamp 16. The drive signal generator 14 generates driving signals for the driver circuit 9 in accordance with the command of the CPU 13.

The CPU 13 is equipped with the following sections (1) through (9) as main functions.

(1) A preheat control section that sets the output voltage of the high-frequency generating circuit 1 to a predetermined level for preheating and allows preheat current to flow in filament electrodes 2*a*, 2*b* of the discharge lamp 2. The level for preheating is stored in the memory 15.

(2) A computing section that imports preheat current If and detecting voltage Vf digital-converted by the A/D converter 12 every predetermined time and computes the impedance Rh of the filament electrode 2*b* of the discharge lamp 2 from the imported preheat current If and detecting voltage Vf at the time of preheating by the preheat control section.

(3) A determining section that determines whether or not the impedance Rh computed by the computing section has reached the preliminarily defined setting RhA. The setting is stored in the memory 15.

(4) A start control section switches the output voltage of the high-frequency generating circuit 1 to the preliminarily defined level for starting (>level for preheating) from the level for preheating so that the discharge lamp 2 is lighted when the determination results of the determining section become positive. The level for starting is stored in the memory 15.

(5) A lighting control section that switches the output voltage of the high-frequency generating circuit 1 from the level for starting to the preliminarily defined level for lighting (<level for starting) in order to maintain lighting of the discharge lamp 2 by the start control section. The level for lighting is stored in the memory 15.

(6) A timer that counts the elapsed time t from the start of preheating by the preheating control section until the determination result of the determining section becomes positive. The elapsed time t counted by the timer is cleared after it is stored in the memory 15.

(7) A correcting section that corrects the level for preheating in accordance with the timer counting time in next preheating by the preheating control section. Specifically, the level for preheating is corrected in such a manner that the timer counting time is brought closer to the preliminarily defined reference time t1 in next preheating by the preheating control section.

(8) A protection section that stops preheating by the preheating control section when the preheat current If is kept zero over the preliminarily defined time setting or the detecting voltage Vf is kept zero over the time setting at the time of preheating by the preheating control section.

(9) When the preheating current If is kept zero beyond the time setting or the detecting voltage Vf is kept zero beyond the time setting at the time of preheating by the preheating control section, the lamp 16 is lighted and the abnormality is annunciated in the determination of being abnormal.

Description will be made on the function.

Driving signals generated in the driving signal generator 14 are supplied to the driver circuit 9 of the high-frequency generating circuit 1. The driver circuit 9 drives to turn ON and OFF the FETs 4 and 5 alternately by frequency (switching frequency) f that corresponds to the driving signal supplied from the driving signal generator 14. With the ON/OFF of the FETs 4 and 5, a resonance circuit comprising the resonance capacitor 6 and resonance coil 7 is energized. By the energization, high-frequency voltage is outputted from the high-frequency generator circuit 1 and the output voltage is applied to the discharge lamp 2.

Figure 2:
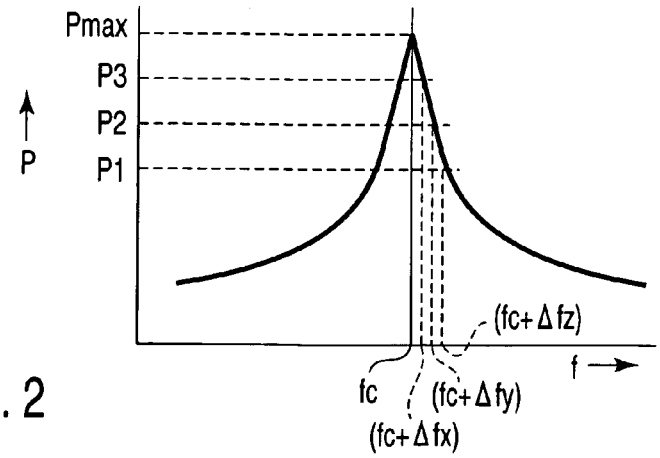
FIG. 2 shows frequency-output characteristics of a resonance circuit in each embodiment.

The resonance circuit provides the frequency-output characteristics as shown in FIG. 2. That is, the resonance circuit has an inherent resonance frequency fc, and the output P of the resonance circuit is maximized when the switching frequency f coincides with the resonance frequency fc. As the switching frequency f shifts up and down around the resonance frequency fc, the output P of the resonance circuit lowers in the lobbing form.

At first, in order to preheat the discharge lamp 2, the switching frequency f is set to the frequency "fc+Δfz" which is Δfz higher than the resonance frequency fc. Thereby, the output voltage of the high-frequency generating circuit 1 is set to the level for preheating and the preheating current If is allowed to flow in filament electrodes 2*a*, 2*b* of the discharge lamp 2 via the preheating capacitor 8. In this way, the discharge lamp 2 is preheated.

During this preheating, the preheat current If is detected by the current detector 10 and, the voltage Vf generated in the filament electrode 2*b* of the discharge lamp 2 is detected by the voltage detector 11. By dividing this detecting voltage Vf by the preheat current If, impedance Rh (=Vf/If) of the filament electrode 2*b* of the discharge lamp 2 is computed. It is determined whether or not the computed impedance Rh has reached the preliminarily defined setting RhA.

Figure 3:
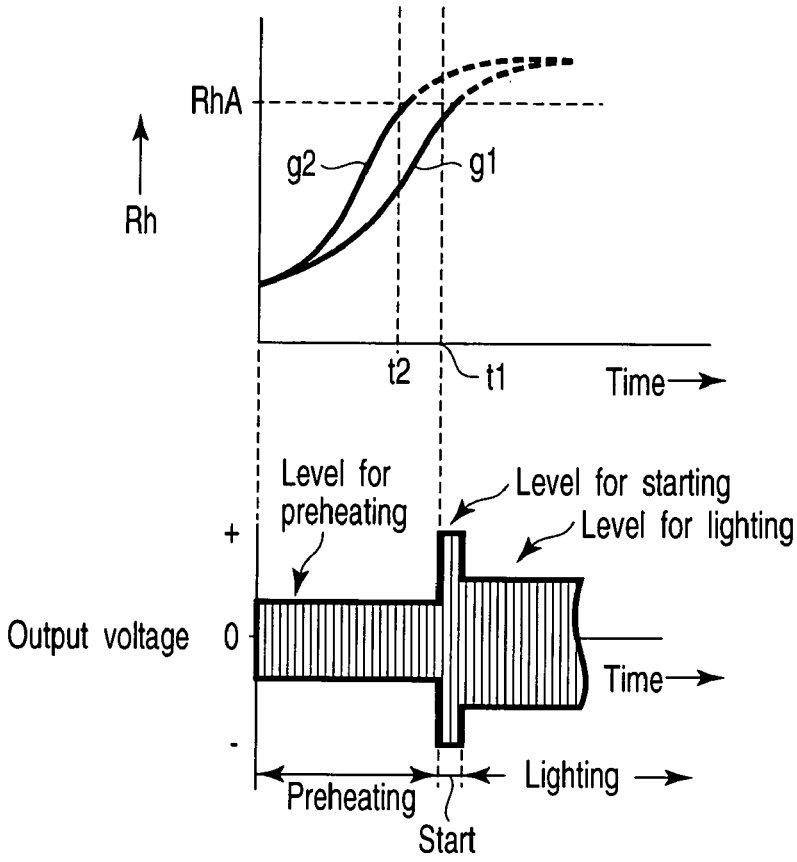
FIG. 3 shows changes of computed impedance and changes of output voltage in the first embodiment.

When, as shown by the curve g1 of FIG. 3, the computed impedance Rh reaches the setting RhA (preheating end timing), the switching frequency f is set to the frequency "fc+Δfx" which is Δfx higher than the resonance frequency fc. This switching frequency "fc+Δfx" is lower than the switching frequency "fc+Δfz" for preheating. Thereby, the output voltage of the high-frequency generating circuit 1 is switched to the level for starting which is higher than the level for preheating.

In this way, start control which increases the output voltage of the high-frequency generating circuit 1 to the level for starting is executed, and by this, the discharge lamp 2 which has been in the lights-out state by then goes on in due course. This start control is executed only for the preliminarily defined predetermined time.

After the start control, the switching frequency f is set to the frequency "fc+Δfy" which is Δfy higher than the resonance frequency fc in order to maintain lighting of the discharge lamp 2. This switching frequency "fc+Δfy" is lower than the switching frequency "fc+Δfz" for starting and is higher than the switching frequency "fc+Δfz" for preheating. Thereby, the output voltage of the high-frequency generating circuit 1 is switched to the level for lighting which is lower than the level for starting.

In this way, by setting the output voltage of the high-frequency generating circuit 1 to the level for lighting, the lighting status of the discharge lamp 2 is maintained.

On the other hand, the elapsed time t from the start of preheating to the time when the start control begins is counted by the timer. In the even that this count time t is shorter than the preliminarily defined reference time (time appropriate for preheating) t1, it is determined that preheating was slightly excessive, and based on this determination, the level for preheating in the memory 15 is corrected in the downward direction at the time of next preheating of the discharge lamp 2.

For example, when the lighting integrated time of the discharge lamp 2 increases or frequency of light-on and light-out of the discharge lamp 2 increases, emitters of filament electrodes 2*a*, 2*b* of the discharge lamp 2 are consumed. When the emitter is consumed, temperature of filament electrodes 2*a*, 2*b* rises quickly, and as a result, the impedance Rh rises quickly. For example, the impedance Rh rises like the curve g2 of FIG. 3 and the time t2 when the impedance Rh reaches the setting RhA becomes shorter than the reference time t1. Since the count time t is t2 (<t1) in such a case, the level for preheating in the memory 15 is corrected in the downward direction under the determination that the preheating amount was slightly excessive.

When the preheating level is corrected in the downward direction, the switch frequency f is increased accordingly. Thereby, the output voltage of high-frequency generating circuit 1 lowers and the preheating amount decreases. By the decreased preheating amount, the time required for preheating comes close to the reference time t1.

Figure 4:
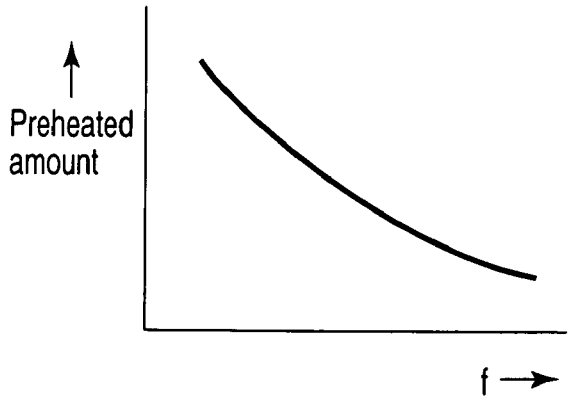
FIG. 4 shows the relationship between the switching frequency and the preheated amount at the time of preheating in the first embodiment.

FIG. 4 shows the relationship between the switching frequency f and the preheating amount.

In addition, for any cause, the impedance Rh of filament electrodes 2*a*, 2*b* in the discharge lamp 2 rises slowly and the time t2 in which the impedance Rh reaches the setting RhA becomes longer than the reference time t1. In the case where the count time t is longer than the reference time t1, it is determined that the preheating amount was slightly short, and based on the determination, the level for preheating in the memory 15 is corrected in the upwards direction in next preheating of the discharge lamp 2.

When the level for preheating is corrected in the upward direction, the switching frequency f is lowered accordingly. Thereby, the output voltage of high-frequency generating circuit 1 rises and the preheating amount increases. By the increased preheating amount, the time required for preheating comes close to the reference time t1.

When the count time t is same as the reference time t1, the preheating amount is determined to be appropriate, and under this determination, the level for preheating in the memory 15 is held as it is.

In this way, the preheating amount (=switching frequency f) of the discharge lamp 2 is corrected properly for each preheating and variations in time required for preheating the discharge lamp 2 can be reduced. As a result, the time before the discharge lamp 2 is lighted can be maintained always constant. Consequently, in the case where a plurality of discharge lamps 2 are lighted concurrently, timing of lighting start of each discharge lamp 2 coincides.

In the next preheating, the level for preheating (=switching frequency f) in the memory 15 may be increased or decreased as much as the difference between the timer count time t and the reference time t1. By doing so, the time required for preheating can be matched accurately to the reference time t1.

In addition, as a correction factor of the level for preheating, not only comparison results of the timer count time t to the reference time t1 but also the light-out time of the discharge lamp 2 before the next preheating begins may be taken into account. For example, when the light-out time is short, next preheating may begin in the condition in which temperature of filament electrodes 2*a*, 2*b* does not lower to the room temperature. In such a case, the time for the impedance Rh to reach the setting RhA is shortened, and the degree of decreasing of the preheating amount is augmented. In this way, by taking into account the light-out time of the discharge lamp 2, the time required for preheating can be matched accurately to the reference time t1.

On the other hand, in the case where no discharge lamp 2 is connected to the high-frequency generating circuit 1, no preheating current flows. In the case where no preheating current flows, the preheat current If detected by the current detection means 10 and the detecting voltage Vf of the voltage detection means 11 become zero.

In the case where the preheat current If detected by the current detection means 10 is zero over longer than the setting time or the detected voltage Vf of the voltage detection means 11 is zero over longer than the setting time, generation of driving signals by the driving signal generator 14 is suspended. Thereby, driving of the high-frequency generating circuit 1 is suspended, and preheating is suspended. At the same time, the lamp 16 goes on and the abnormality is annunciated.

In this way, when the load, discharge lamp 2, is not mounted, driving of the high-frequency generating circuit 1 is suspended and safety is thereby secured. In addition, since the lamp 16 goes on, the user is expedited to mount the discharge lamp 2.

[2] Description will be made on a second embodiment of the present invention.

The preheating control section of the second embodiment controls the output voltage of the high-frequency generating circuit 1 in such a manner that the preheat current If detected by the current detector 10 achieves the preliminarily defined target level and allows the preheating current to flow in the filament electrodes 2*a*, 2*b* of the discharge lamp 2. The target level is stored in the memory 15.

In addition, the correcting section in the second embodiment corrects the target level in accordance with the timer count time t in the next preheating by the preheating control section.

Description will be made on the function.

The elapsed time t from the start of preheating to the time when the start control begins is counted by the timer. In the case where this count time t is shorter than the preliminarily defined reference time t1, it is determined that preheating was slightly excessive, and based on this determination, the target level in the memory 15 is lowered from previous If1 to If2 at the time of next preheating of the discharge lamp 2.

When the target level is lowered, the switch frequency f is increased accordingly. Thereby, the output voltage of high-frequency generating circuit 1 lowers and the preheating amount decreases. By the decreased preheating amount, the time required for preheating comes close to the reference time t1.

Figure 5:
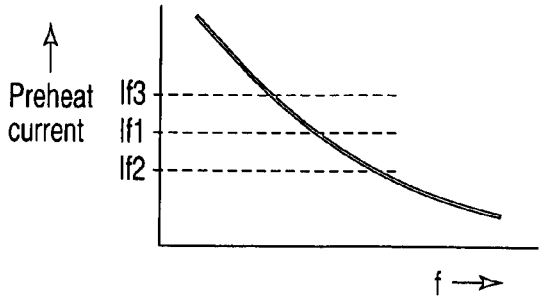
FIG. 5 shows the relationship between the switching frequency and the preheat current at the time of preheating in a second embodiment.

FIG. 5 shows the relationship between the switching frequency f and the preheating amount.

In the case where the cont time t is longer than the reference time t1, it is determined that the preheating amount was slightly short, and based on the determination, the target level in the memory 15 is raised from previous If1 to If3 in next preheating of the discharge lamp 2.

When the target level is raised, the switching frequency f is lowered accordingly. Thereby, the output voltage of high-frequency generating circuit 1 rises and the preheating amount increases. By the increased preheating amount, the time required for preheating comes close to the reference time t1.

When the count time t is same as the reference time t1, the preheating amount is determined to be appropriate, and under this determination, the target level for preheating in the memory 15 is held to If1 as it is.

In this way, the preheating amount (=switching frequency f) of the discharge lamp 2 is corrected properly for each preheating and variations in time required for preheating the discharge lamp 2 can be reduced. As a result, the time before the discharge lamp 2 is lighted can be maintained always constant. Consequently, in the case where a plurality of discharge lamps 2 are lighted concurrently, timing of lighting start of each discharge lamp 2 coincides.

In the next preheating, the target level (=switching frequency f) in the memory 15 may be increased or decreased as much as the difference between the timer count time t and the reference time t1. By doing so, the time required for preheating can be matched accurately to the reference time t1.

Other configuration, function, and effects are same as those of the first embodiment. Consequently, the description will be omitted.

[3] Description will be made on a third embodiment of the present invention.

Figure 6:
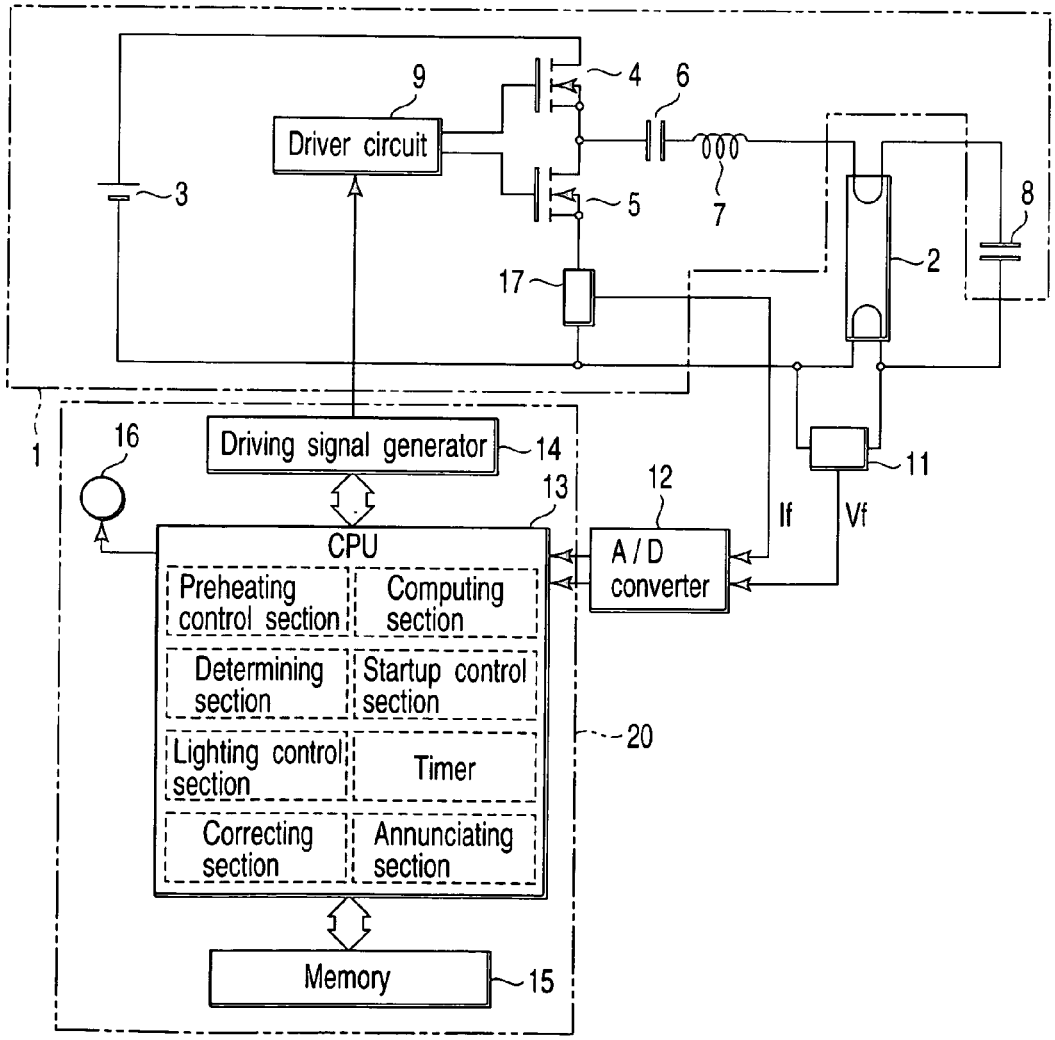
FIG. 6 shows a configuration of a third embodiment.

In place of the current detector 10 of the first embodiment, as shown in FIG. 6, current detecting means 17 is mounted on a line between the of the source FET 5 and the negative side terminal of the DC power supply 3. Thereby, the current detecting means 17, preheat current If is detected.

Other configuration, function, and effects are same as those of the first embodiment. Consequently, the description will be omitted.

[4] Description will be made on a fourth embodiment of the present invention.

Figure 7:
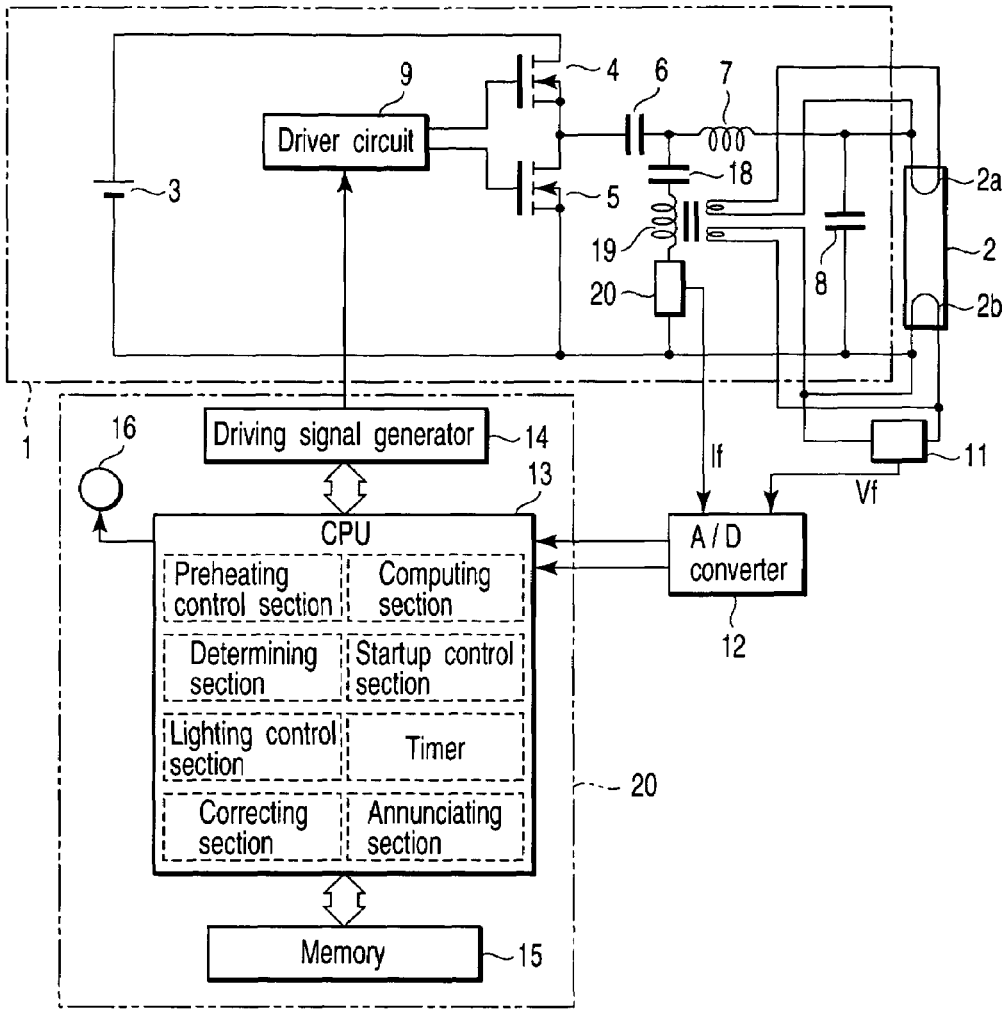
FIG. 7 shows a configuration of a fourth embodiment.

As shown in FIG. 7, a transformer preheating system is adopted. That is, one end of a primary winding of the transformer 19 is connected to the connections between the resonance capacitor 6 and the resonance coil 7 via a capacitor 18. A source of the FET 5 is connected to the other end of the primary winding of the transformer 19 via current detection means 20. The filament electrode 2*a* of the discharge lamp 2 is connected to one of a secondary wiring of the transformer 19. The filament electrode 2*b* of the discharge lamp 2 is connected to the other secondary wiring of the transformer 19. The preheating capacitor 8 is connected between one end of the filament electrode 2*a* and one end of the filament electrode 2*b*. The preheat current If is detected by the current detector 20.

Other configuration, function, and effects are same as those of the first embodiment. Consequently, the description will be omitted.

[5] Description will be made on a fifth embodiment of the present invention.

Figure 8:
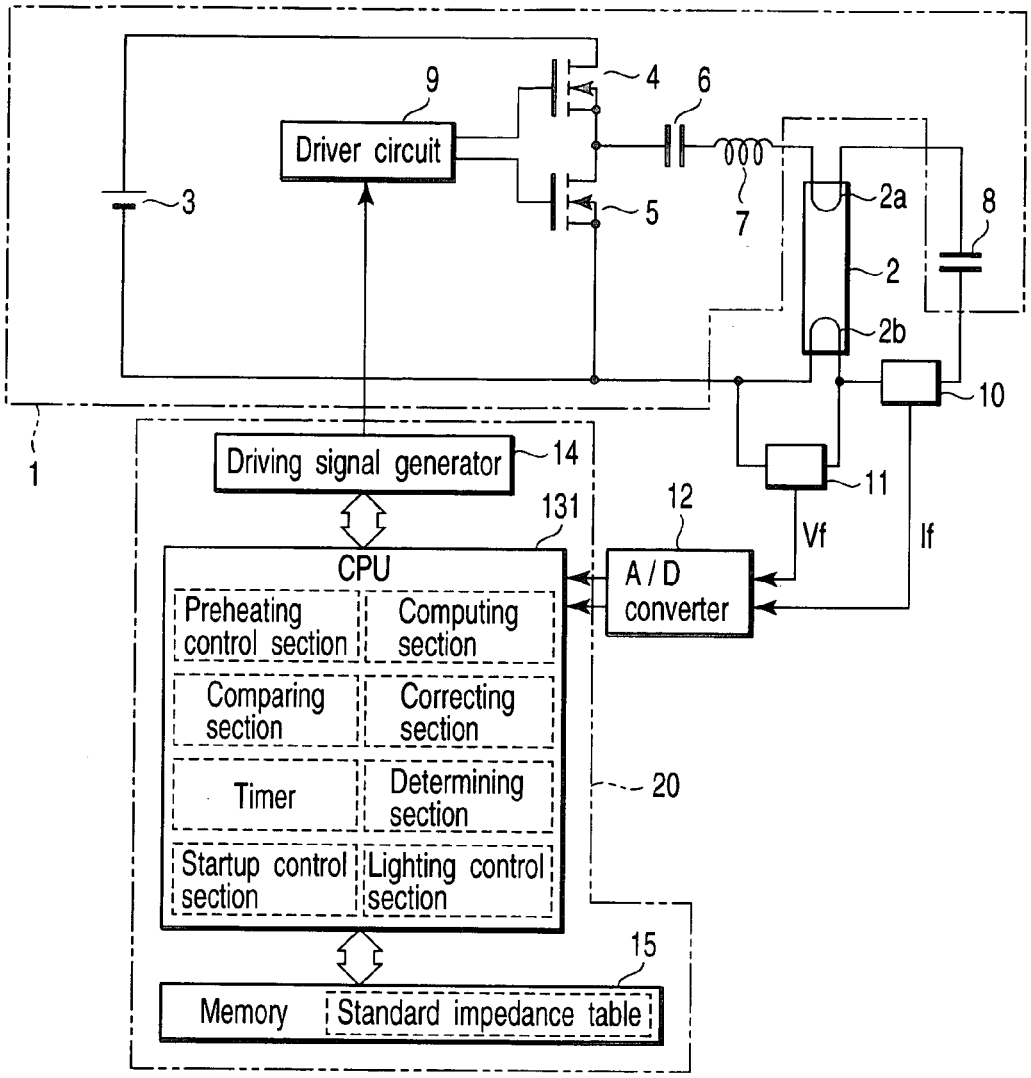
FIG. 8 shows a configuration of a fifth embodiment.

In place of the CPU 13 of the first embodiment, a CPU 131 is adopted as shown in FIG. 8. The CPU 131 has the following sections (1) to (8) as main functions.

(1) A preheat control section that sets the output voltage of the high-frequency generating circuit 1 to a preliminarily defined level for preheating and allows preheat current to flow in filament electrodes 2*a*, 2*b* of the discharge lamp.

(2) A computing section that imports preheat current If and detecting voltage Vf digital-converted by the A/D converter 12 and computes the impedance Rh of the filament electrode 2*b* of the discharge lamp 2 from the imported preheat current If and detecting voltage Vf at the time of preheating by the preheat control section every predetermined time. Note that the impedance Rh computed every predetermined time is designated as the impedance Rh(i). Reference character i denotes an integer 1 through n that correspond the number of computations every predetermined time. In correspondence to the computation of this computation section at every predetermined time, a plurality of standard impedance Rhref(i) preliminarily defined stepwise are stored in a standard impedance table in the memory 15.

(3) A comparing section that compares the computed impedance Rh(i) to the standard impedance Rhref(i) in the standard impedance table that correspond to the computation every time the impedance Rh(i) is computed by the computing section at the time of preheating by the preheating control section.

(4) A correcting section that corrects the level for preheating (=switching frequency f) in accordance with the comparison results every time the comparison section compares. Specifically, the level for preheating is corrected in such a manner that impedance Rh(i) coincides with the standard impedance Rhref(i).

(5) A timer that counts the elapsed time t from the start of preheating by the preheating control section.

(6) A determining section that determines whether or not the timer count time t has reached the preliminarily defined preheating time Tph. The preheating time Tph is stored in the memory 15.

(7) A start control section switches the output voltage of the high-frequency generating circuit 1 to the preliminarily defined level for starting (>level for preheating) from the level for preheating so that the discharge lamp 2 is lighted when the determination results of the determining section become positive.

(8) A lighting control section that switches the output voltage of the high-frequency generating circuit 1 from the level for starting to the preliminarily defined level for lighting (<level for starting) in order to maintain lighting of the discharge lamp 2 by the start control section.

The function is described as follows.

Every time the impedance Rh(i) of the filament electrode 2*b* is computed at the time of preheating the discharge lamp 2, the computed impedance Rh(i) is compared with the standard impedance Rhref(i) in the standard impedance table that corresponds to the computation. The level for preheating (=switching frequency f) is corrected in such a manner that the impedance Rh(i) coincides with the standard impedance Rhref(i), that is, the difference between the impedance Rh(i) and the standard impedance Rhref(i) becomes zero.

For example, in the case where the impedance Rh(i) is greater than the standard impedance Rhref(i), the level for preheating is corrected in the downward direction and accordingly, the switching frequency f is increased. Thereby, the preheating amount is decreased.

Figure 9:
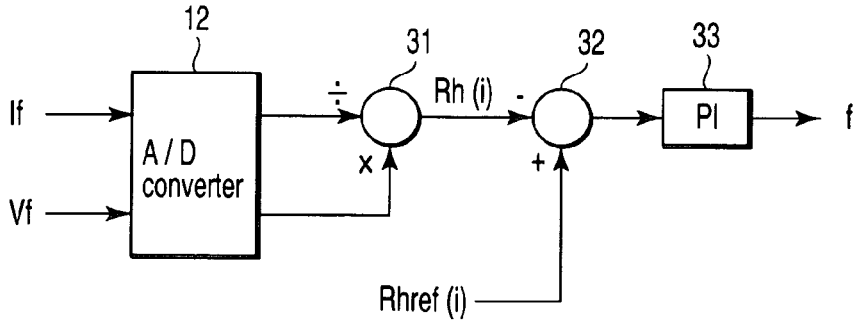
FIG. 9 shows a sequence pattern of program processing in the fifth embodiment.

To show the CPU 131 program processing by a sequence pattern, FIG. 9 is obtained. That is, the preheat current If(i) and detecting voltage detection value Vf(i) A/D-converted by the A/D converter 12 are supplied to computing means 31. The computing means 31 computes the impedance Rh(i) by computation of Vf(i)/If(i). The impedance Rh(i) is supplied to computing means 32. The computing means 32 subtracts the impedance Rh(i) from the standard impedance Rhref(i). This reduction result is supplied to proportional-plus-integral control means 33. The proportional-plus-integral control means 33 finds the switching frequency f to bring the reduction result close to zero by proportional-plus-integral control, that is, PI control.

Figure 10:
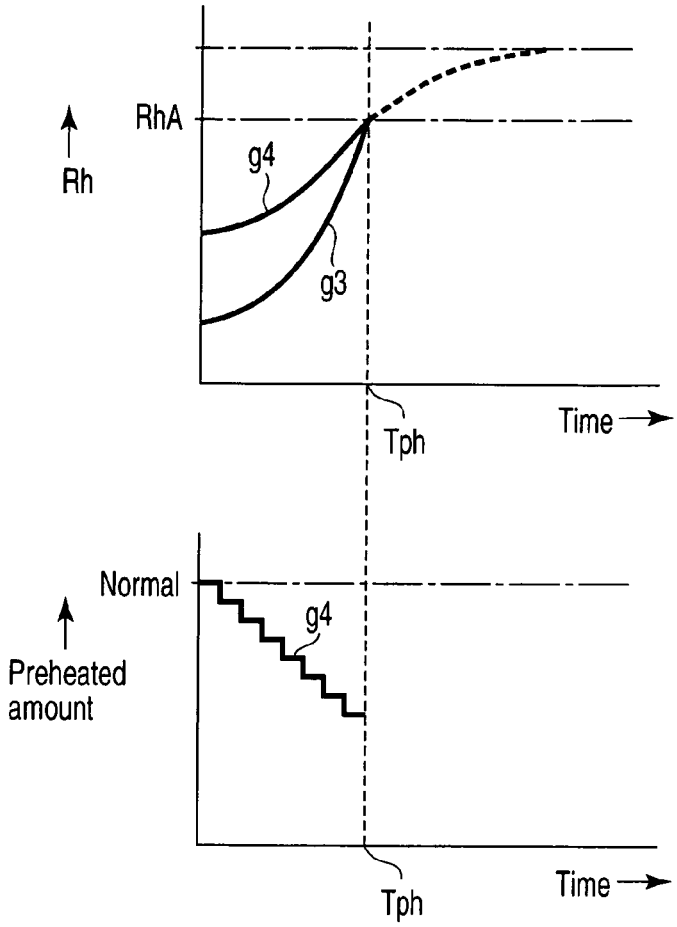
FIG. 10 shows changes of computation impedance and changes of preheated amount in the fifth embodiment.

FIG. 10 shows changes of impedance Rh and changes of preheating amount.

In the pattern g3 in which the impedance Rh(i) rises constantly in conformity to the standard impedance Rhref(i), the switching frequency f (=preheating amount) does not change. On the other hand, in the pattern g4 in which the impedance Rh(i) changes in the condition where the impedance Rh(i) is higher than the standard impedance Rhref(i), the switching frequency f (=preheating amount) lowers stepwise.

From the start of preheating, the elapsed time t is counted by the timer. In both pattern g3 and pattern g4, the impedance Rh attains the setting RhA in such a timing that the timer count time t reaches the preheating time Tph. In the same timing, the output voltage of the high-frequency generating circuit 1 is switched from the level for preheating to the level for starting.

Other configuration, function, and effects are same as those of the first embodiment. Consequently, the description will be omitted.

[6] Description will be made on a sixth embodiment of the present invention.

Figure 11:
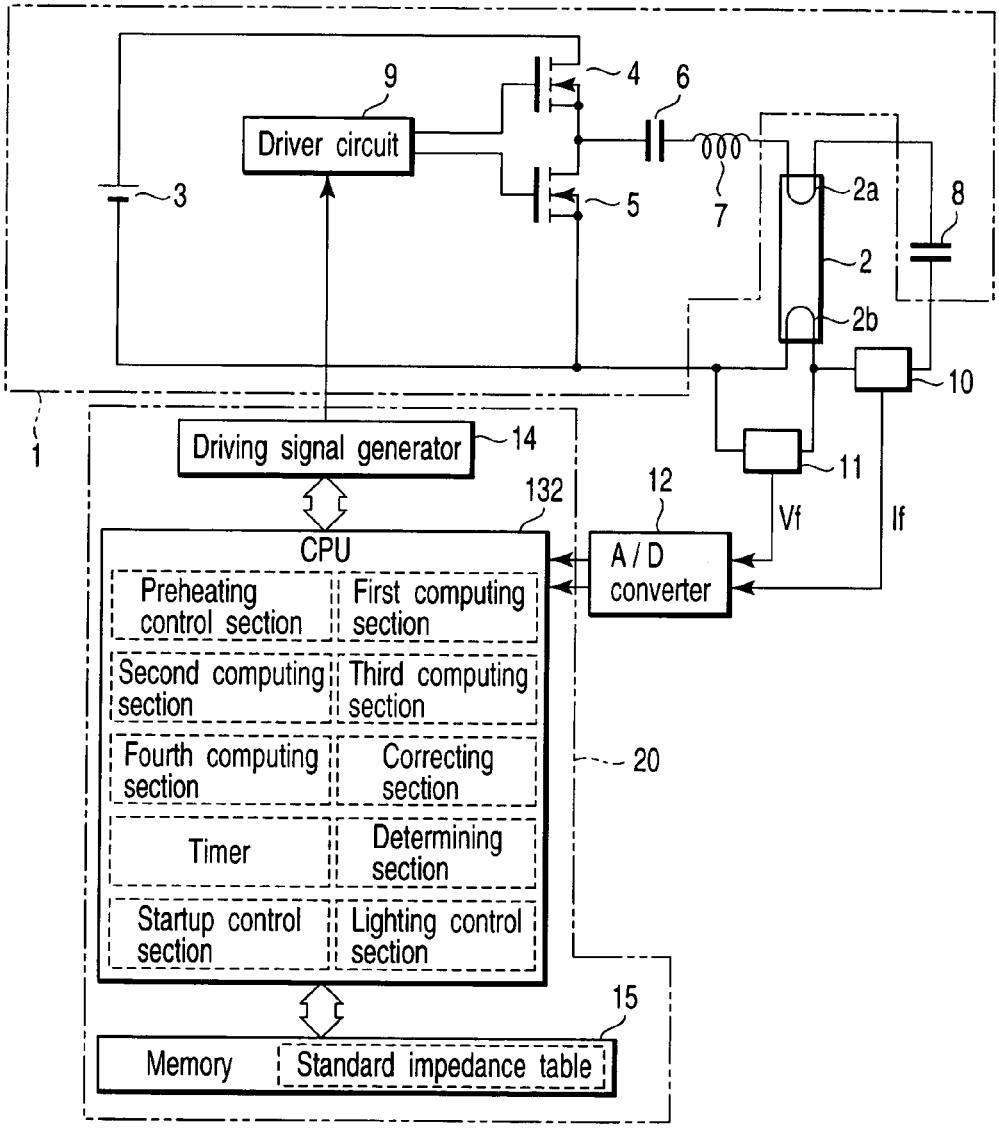
FIG. 11 shows a configuration of a sixth embodiment.

In place of the CPU 13 of the first embodiment, a CPU 132 is adopted as shown in FIG. 11. The CPU 132 has the following sections (1) to (10) as main functions.

(1) A preheat control section that sets the output voltage of the high-frequency generating circuit 1 to a preliminarily defined level for preheating and allows preheat current to flow in filament electrodes 2*a*, 2*b* of the discharge lamp 2.

(2) A first computing section that imports preheat current If and detecting voltage Vf digital-converted by the A/D converter 12 and computes the impedance Rh of the filament electrode 2*b* of the discharge lamp 2 from the imported preheat current If and detecting voltage Vf at the time of preheating by the preheat control section every predetermined time. The impedance Rh(i) computed for the first time is stored in the memory 15 as the impedance Rc. Furthermore, in correspondence to the computation of this computation section at every predetermined time, a plurality of standard impedance Rhref(i) preliminarily defined stepwise are stored in a standard impedance table in the memory 15.

(3) A second computing section that computes the ratio (Rhref(i)/Rc) of the standard impedance Rhref(i) in the standard impedance table that correspond to the computation every time the impedance Rh(i) is computed by the first computing section at the time of preheating by the preheating control section to the desired impedance Rc stored.

(4) A third computing section that computes the ratio (Rh(i)/Rc) of the computed impedance Rh(i) to the stored desired impedance Rc every time the impedance Rh(i) is computed at the first computing section at the time of preheating by the preheating control section to the desired impedance Rc stored.

(5) A fourth computing section that computes the difference [(Rhref(i)/Rc)−(Rh(i)/Rc)] between the ratio (Rhref(i)/Rc)) computed in the second computing section and the ratio (Rh(i)/Rc) computed in the third computing section.

(6) A correcting section that corrects the level for preheating (=switching frequency f) in the direction that the difference [Rhref(i)/Rc)−(Rh(i)/Rc)] computed in the fourth computing section becomes zero.

(7) A timer that counts the elapsed time t from the start of preheating by the preheating control section.

(8) A determining section that determines whether or not the timer count time t has reached the preliminarily defined preheating time Tph.

(9) A start control section switches the output voltage of the high-frequency generating circuit 1 to the preliminarily defined level for starting (>level for preheating) from the level for preheating so that the discharge lamp 2 is lighted when the determination results of the determining section become positive.

(10) A lighting control section that switches the output voltage of the high-frequency generating circuit 1 from the level for starting to the preliminarily defined level for lighting (<level for starting) in order to maintain lighting of the discharge lamp 2 by the start control section.

Figure 12:
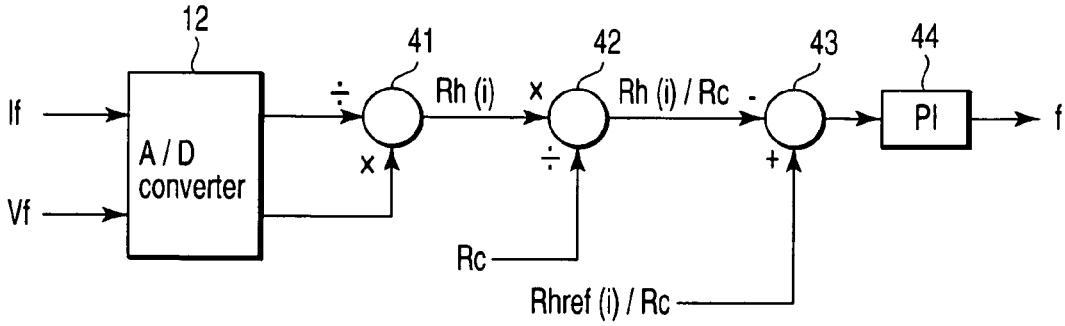
FIG. 12 shows a sequence pattern of program processing of the sixth embodiment.

To show the CPU 132 program processing by a sequence pattern, FIG. 12 is obtained. That is, the preheat current If(i) and detecting voltage detection value Vf(i) A/D-converted by the A/D converter 12 are supplied to computing means 41. The computing means 41 computes the impedance Rh(i) by computation of Vf(i)/If(i). The impedance Rh(i) is supplied to computing means 42. The computing means 42 computes the ratio (Rh(i)/Rc) of the impedance Rh(i) to the desired impedance Rc. This computation result is supplied to computing means 43. The ratio (Rhref(i)/Rc) of the standard impedance Rhref(i) to the desired impedance Rc is supplied to the computing means 43 as well. The computing means 43 computes the difference [(Rhref(i)/Rc)−(Rh(i)/Rd)] between the ratio (Rhref(i)/Rc) and ratio (Rh(i)/Rc). This computation results is supplied to proportional-plus-integral control means 44. The proportional-plus-integral control means 44 finds the switching frequency f to bring the difference [(Rhref(i)/Rc−(Rh(i)/Rc)] close to zero by proportional-plus-integral control, that is, PI control.

In the case where the rising change of impedance Rh(i) is greater than the standard rising change, the ratio (Rh(i)/Rc) increases. Therefore, the difference [(Rhref(i)/Rc)−(Rh(i)/Rc)] is found and the switching frequency f is controlled in such a manner that the difference is brought closer to zero. The difference in such a case becomes a negative value. If the difference is negative, the preheating amount must be reduced, and therefore, the switching frequency f is increased. In this way, the degree of rise in impedance Rh(i) is suppressed.

From the start of preheating, the elapsed time t is counted by the timer. The ratio (Rhref(i)/Rh(i)) reaches the preliminarily defined predetermined value a in such a timing that the timer count time t reaches the preheating time Tph. In the same timing, the output voltage of the high-frequency generating circuit 1 is switched from the level for preheating to the level for starting.

Other configuration, function, and effects are same as those of the first embodiment. Consequently, the description will be omitted.

[7] Description will be made on a seventh embodiment of the present invention.

Figure 13:
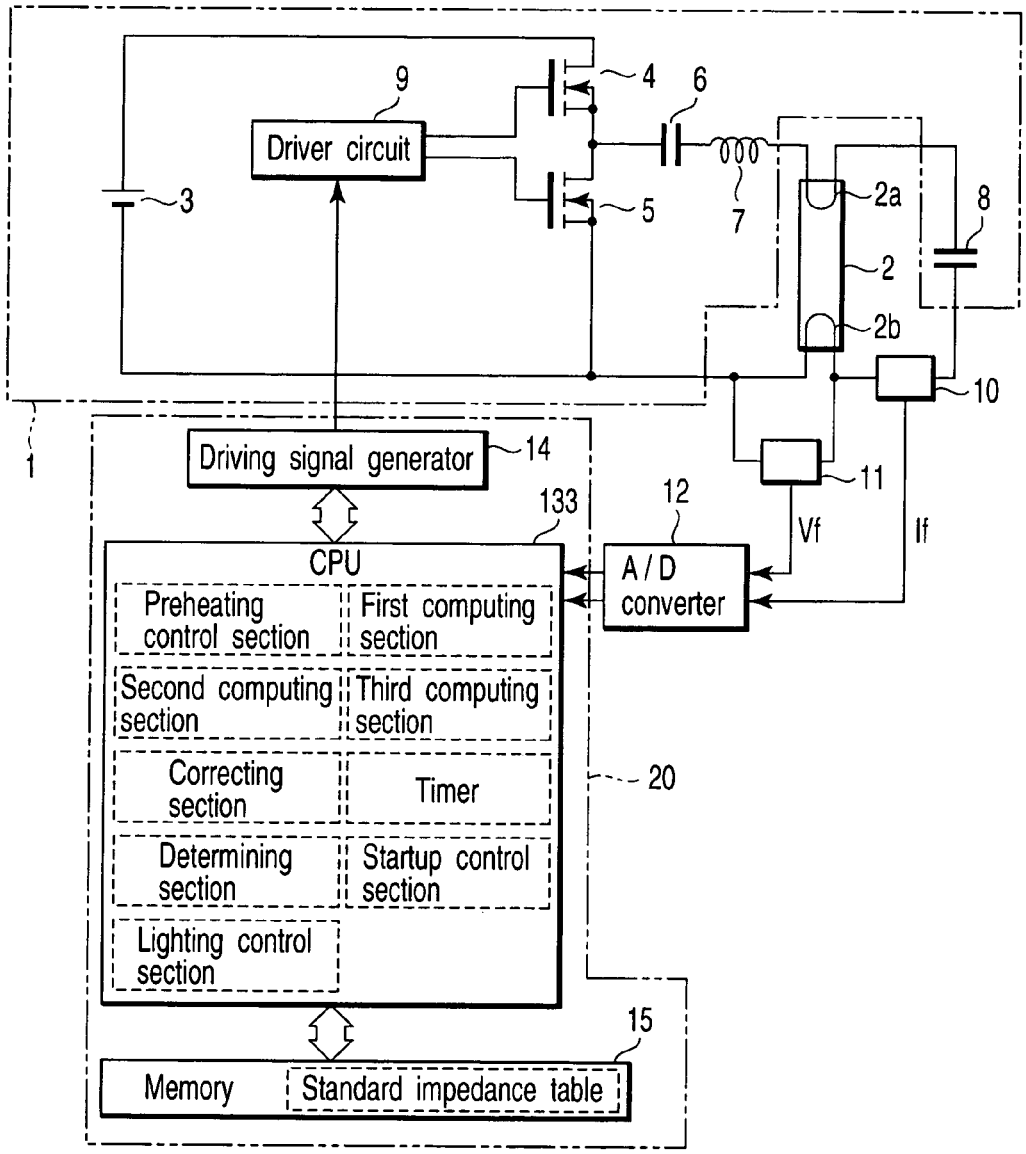
FIG. 13 shows a configuration of a seventh embodiment.

In place of the CPU 13 of the first embodiment, a CPU 133 is adopted as shown in FIG. 13. The CPU 133 has the following sections (1) to (9) as main functions.

(1) A preheat control section that sets the output voltage of the high-frequency generating circuit 1 to a preliminarily defined level for preheating and allows preheat current to flow in filament electrodes 2*a*, 2*b* of the discharge lamp 2. The level for preheating is stored in the memory 15.

(2) A first computing section that imports preheat current If and detecting voltage Vf digital-converted by the A/D converter 12 and computes the impedance Rh of the filament electrode 2*b* of the discharge lamp 2 from the imported preheat current If and detecting voltage Vf at the time of preheating by the preheat control section every predetermined time. The impedance Rh computed every predetermined time is designated as the impedance Rh(i). This impedance Rh(i) is temporarily stored in the memory 15.

(3) A second computing section that computes the impedance difference ΔRh(i) between the computed impedance Rh(i) every time the impedance Rh(i) is computed by the first computing section at the time of preheating by the preheating control section and the last computed impedance Rh(i−1). A plurality of standard impedance difference ΔRhref(i) preliminarily defined stepwise in correspondence with each computation of this second computation section are stored in the standard impedance table of the memory 15.

(4) A third computing section that computes the difference [ΔRhref(i)−ΔRh(i)] between the impedance difference ΔRh (i) computed every time the impedance difference ΔRh(i) is computed at the second computing section at the time of preheating by the preheating control section and the standard impedance difference ΔRhref(i) in the standard impedance table which corresponds to the computation.

(5) A correcting section that corrects the level for preheating (=switching frequency f) in the direction that [ΔRhref(i)−ΔRh(i))] computed in the third computing section becomes zero.

(6) A timer that counts the elapsed time t from the start of preheating by the preheating control section.

(7) A determining section that determines whether or not the timer count time t has reached the preliminarily defined preheating time Tph.

(8) A start control section switches the output voltage of the high-frequency generating circuit 1 to the preliminarily defined level for starting (>level for preheating) from the level for preheating so that the discharge lamp 2 is lighted when the determination results of the determining section become positive.

(9) A lighting control section that switches the output voltage of the high-frequency generating circuit 1 from the level for starting to the preliminarily defined level for lighting (<level for starting) in order to maintain lighting of the discharge lamp 2 by the start control section.

Figure 14:
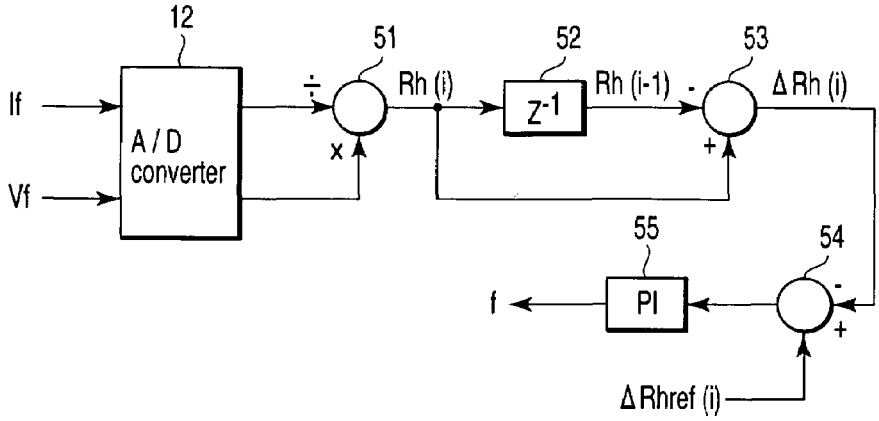
FIG. 14 shows a sequence pattern of program processing of the seventh embodiment.

To show the CPU 133 program processing by a sequence pattern, FIG. 14 is obtained. That is, the preheat current If(i) and detecting voltage detection value Vf(i) A/D-converted by the A/D converter 12 are supplied to computing means 51. The computing means 51 computes the impedance Rh(i) by computation of Vf(i)/If(i). This impedance Rh(i) is supplied to temporary storage means 52 and computing means 53. The temporary storage means 52 outputs the last impedance Rh(i−1) computed one step ahead of the impedance Rh(i). This output is supplied to the computing means 53. The computing means 53 computes the impedance difference ΔRh(i) between the impedance Rh(i) and the last impedance Rh(i−1). This computation result is supplied to computing means 54. The standard impedance difference ΔRhref(i) is supplied to the computing means 54 as well. The computing means 54 computes the difference [ΔRhref (i)−ΔRh(i)] between the impedance difference ΔRh(i) and the standard impedance difference ΔRhref(i). This computation result is supplied to proportional-plus-integral control means 55. The proportional-plus-integral control means 55 finds the switching frequency f to bring the difference [ΔRhref(i)−ΔRh(i)] close to zero by proportional-plus-integral control, that is, PI control.

Figure 15:
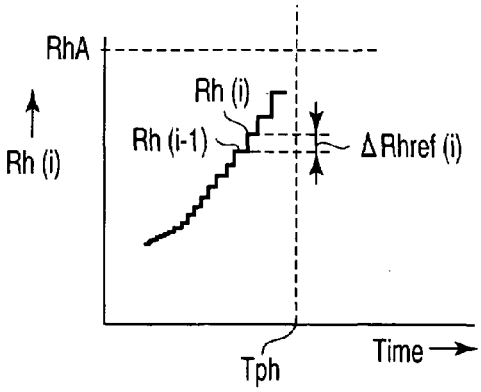
FIG. 15 shows changes of computed impedance in the seventh embodiment.
Figure 16:
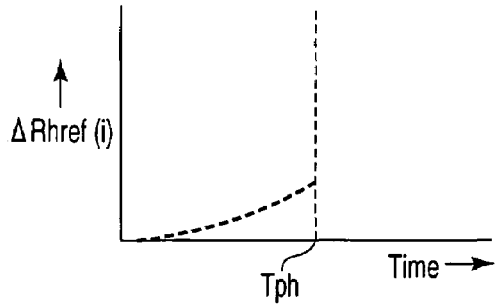
FIG. 16 is a graph that indicates plots of standard impedance in the seventh embodiment.

FIG. 15 shows the relationship between changes of impedance Rh(i) and the standard impedance difference ΔRhref(i). FIG. 16 is a graph that plots the standard impedance difference ΔRhref(i) at regular time intervals.

In the case where the rising change of impedance Rh(i) is greater than the standard rising change, the impedance difference ΔRh increases as well. Therefore, the difference [ΔRhref(i)−ΔRh(i))] is found and the switching frequency f is controlled in such a manner that the difference is brought closer to zero. The difference in such a case becomes a negative value. If the difference is negative, the preheating amount must be reduced, and therefore, the switching frequency f is increased. In this way, the degree of rise in impedance Rh(i) is suppressed.

From the start of preheating, the elapsed time t is counted by the timer. The impedance Rh reaches the setting RhA in such a timing that the timer count time t reaches the preheating time Tph. In the same timing, the output voltage of the high-frequency generating circuit 1 is switched from the level for preheating to the level for starting.

Other configuration, function, and effects are same as those of the first embodiment. Consequently, the description will be omitted.

[8] Description will be made on an eighth embodiment of the present invention.

Figure 17:
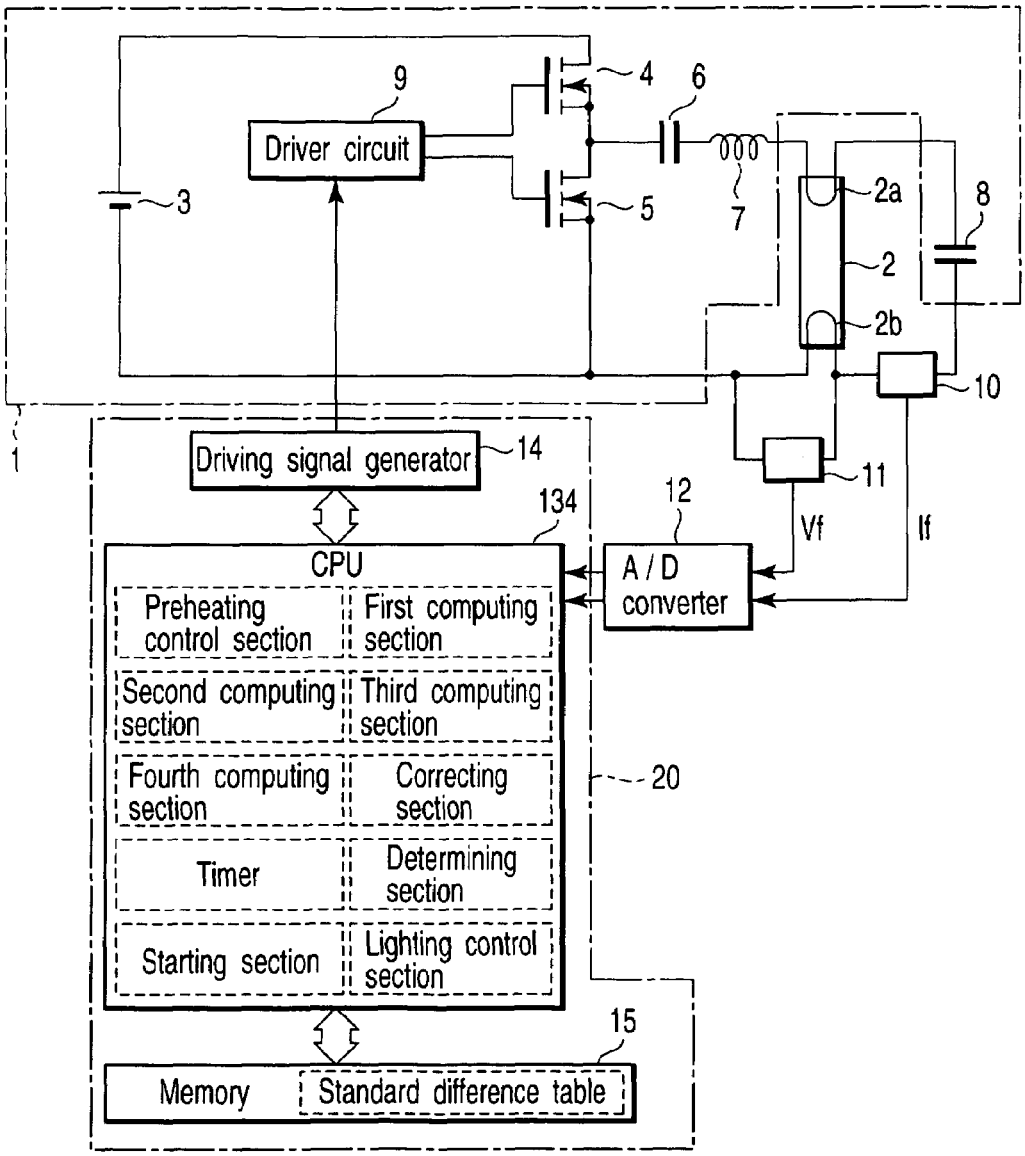
FIG. 17 shows a configuration of an eighth embodiment.
Figure 18:
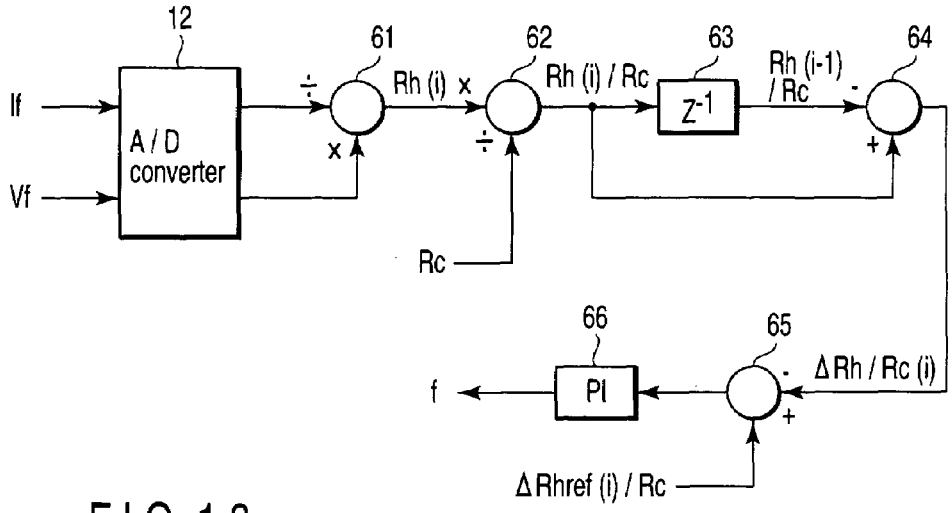
FIG. 18 shows a sequence pattern of program processing of the eighth embodiment.

In place of the CPU 13 of the first embodiment, a CPU 134 is adopted as shown in FIG. 17. The CPU 134 has the following sections (1) to (10) as main functions.

(1) A preheat control section that sets the output voltage of the high-frequency generating circuit 1 to a level for preheating and allows preheat current to flow in filament electrodes 2*a*, 2*b* of the discharge lamp.

(2) A first computing section that imports preheat current If and detecting voltage Vf digital-converted by the A/D converter 12 and computes the impedance Rh of the filament electrode 2*b* of the discharge lamp 2 from the imported preheat current If and detecting voltage Vf at the time of preheating by the preheat control section every predetermined time. The impedance Rh computed at regular time intervals is called the impedance Rh(i). In addition, the impedance Rh(i) computed for the first time is stored in the memory 15 as the impedance Rc.

(3) A second computing section that computes the ratio (Rh(i)/Rc) of the impedance Rh(i) computed every time the impedance Rh(i) is computed by the first computing section at the time of preheating by the preheating control section to the desired impedance Rc stored. The impedance Rh(i) computed in this second computing section is temporarily stored in the memory 15.

(4) A third computing section that computes the difference Δ(Rh(i)/Rc) [=Rh(i)/Rc)−(Rh(i−1)/Rc)] between the computed ratio (Rh(i)/Rc) to the last ratio (Rh(i−1)/Rc) computed by the second computing means every time the ratio (Rh(i)/Rc) is computed at the second computing section at the time of preheating control section. A plurality of standard difference Δ(Rhref(i)/Rc) preliminarily defined stepwise in correspondence with each computation of this third computing section are stored in the standard difference table in the memory 15.

(5) A fourth computing section that computes the difference [Δ(Rhref(i)/Rc)−Δ(Rh(i)/Rc)] between the computed difference Δ(Rh(i)/Rc) and the standard difference Δ(Rhref (i)/Rc) in the standard difference table that corresponds to the computation every time the difference Δ(Rh(i)/Rc) is computed at the third computing section at the time of preheating by the preheating control section.

(6) A correcting section that corrects the level for preheating (=switching frequency f) in the direction that the difference [Δ(Rhref(i)/Rc)−Δ(Rh(i)/Rc)] computed in the fourth computing section becomes zero.

(7) A timer that counts the elapsed time t from the start of preheating by the preheating control section.

(8) A determining section that determines whether or not the timer count time t has reached the preliminarily defined preheating time Tph.

(9) A start control section switches the output voltage of the high-frequency generating circuit 1 to the preliminarily defined level for starting (>level for preheating) from the level for preheating so that the discharge lamp 2 is lighted when the determination results of the determining section become positive.

(10) A lighting control section that switches the output voltage of the high-frequency generating circuit 1 from the level for starting to the preliminarily defined level for lighting (<level for starting) in order to maintain lighting of the discharge lamp 2 by the start control section.

To show the CPU 134 program processing by a sequence pattern, FIG. 15 is obtained. That is, the preheat current If(i) and detecting voltage detection value Vf(i) A/D-converted by the A/D converter 12 are supplied to computing means 61. The computing means 61 computes the impedance Rh(i) by computing Vf(i)/If(i). This computation results is supplied to computing means 62. The computing means 62 computes a ratio (Rh(i)/Rc) between the impedance Rh(i) and the desired impedance Rc. This ratio (Rh(i)/Rc) is supplied to temporary storage means 63 and computing means 64. The temporary storage means 63 outputs the ratio (Rh(i−1)/Rc) computed one before the ratio (Rh(i)/Rc) every time the temporary storage means 63 receives the ratio (Rh(i)/Rc). This output is supplied to computing means 64. The computing means 64 computes the difference Δ(Rh(i)/Rc) between the ratio (Rh(i)/Rc) and the ratio (Rh(i−1)/Rc). This computation output is supplied to computing means 65. The standard difference Δ(Rhref(i)/Rc) is supplied to the computing means 65 as well. The computing means 65 computes the difference [Δ(Rhref(i)/Rc)−Δ(Rh(i)/Rc)] between the difference Δ(Rh(i)/Rc) and standard difference Δ(Rhref(i)/Rc)−(Rh(i)/Rc). This computation results is supplied to proportional-plus-integral control means 66. The proportional-plus-integral control means 66 finds the switching frequency f to bring the difference [Δ(Rhref(i)/Rc−Δ(Rh(i)/Rc)] close to zero by proportional-plus-integral control, that is, PI control.

Figure 19:
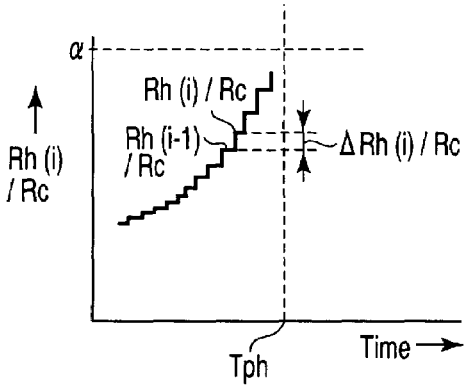
FIG. 19 shows changes of a ratio of computed impedance to the desired impedance in the eighth embodiment.
Figure 20:
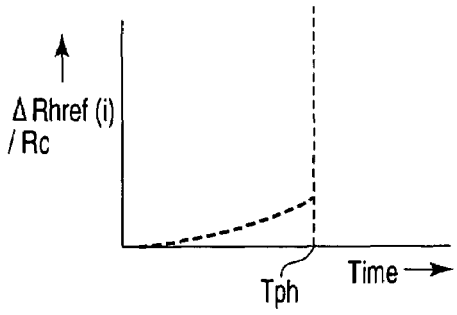
FIG. 20 is a graph that indicates plots of standard difference in the eighth embodiment.

FIG. 19 shows the relationship between changes of the ratio (Rh(i)/Rc)] and standard difference Δ(Rhref(i)/Rc). FIG. 20 is a graph which plots standard difference Δ(Rhref (i)/Rc) at regular time intervals.

In the case where the rising change of impedance Rh(i) is greater than the standard rising change, the ratio (Rh(i)/Rc) increases and the difference Δ(Rh(i)/R) increases as well. Therefore, the difference [Δ(Rhref(i)/Rc)−Δ(Rh(i)/Rc)] is found and the switching frequency f is controlled in such a manner that the difference is brought closer to zero. The difference [Δ(Rhref(i)/Rc)−Δ(Rh(i)/Rc)] in such a case becomes a negative value. If the difference is negative, the preheating amount must be reduced, and therefore, the switching frequency f is increased. In this way, the degree of rise in impedance Rh(i) is suppressed.

From the start of preheating, the elapsed time t is counted by the timer. The ratio (Rhref(i)/Rh(i)) reaches the preliminarily defined predetermined value α in such a timing that the timer count time t reaches the preheating time Tph. In the timing that the count time of timer reaches the preheating time Tph, the output voltage of the high-frequency generating circuit 1 is switched from the level for preheating to the level for starting.

Other configuration, function, and effects are same as those of the first embodiment. Consequently, the description will be omitted.

[9] Description will be made on a ninth embodiment of the present invention. The ninth embodiment is a modification of the fifth embodiment described above.

Figure 21:
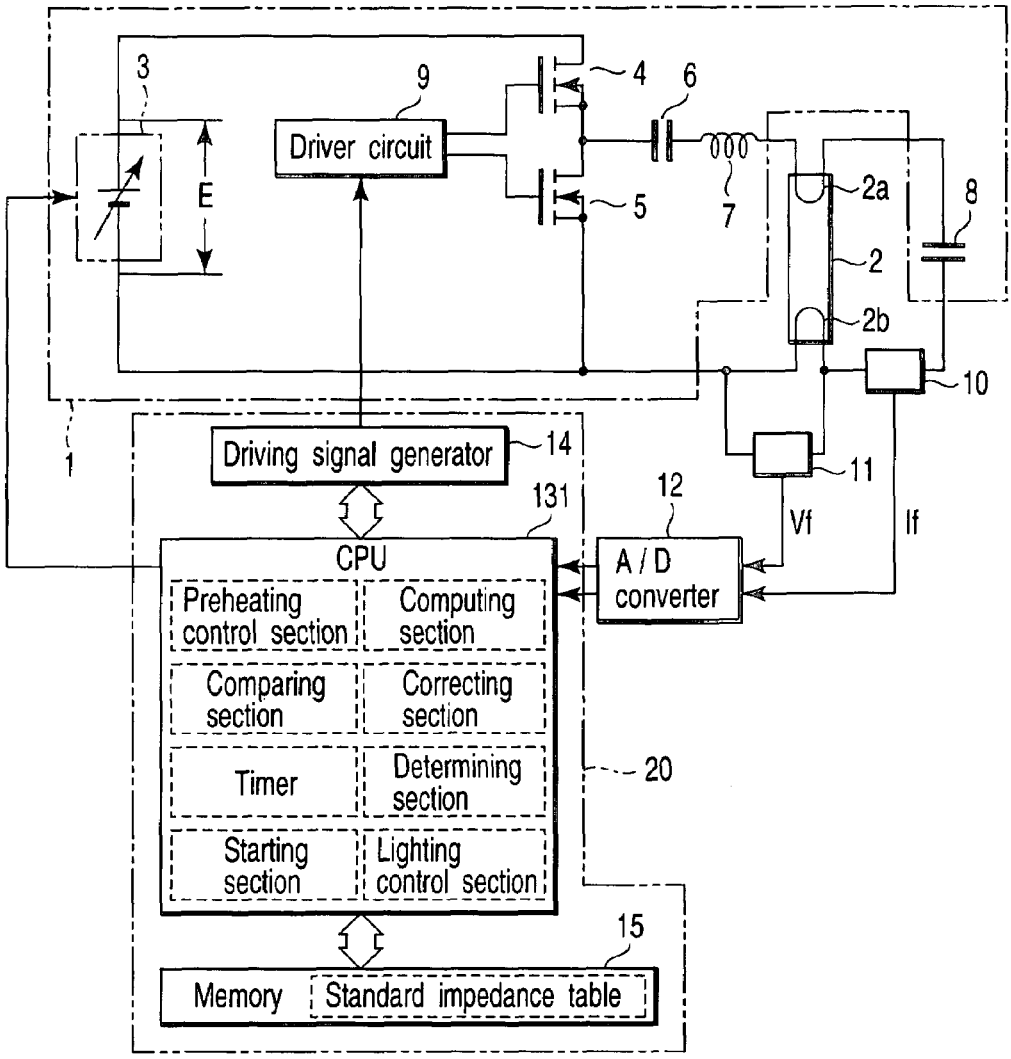
FIG. 21 shows a configuration of a ninth embodiment.

As shown in FIG. 21, voltage E of the DC power supply 3 of the high-frequency generating circuit 1 is controlled by the CPU 131 of the controller 20.

Of all sections of the CPU 131, the correcting section only differs from the fifth embodiment. In the fifth embodiment, the level for preheating (=switching frequency f) is corrected to control the preheating amount, but in this ninth embodiment, the voltage E of the DC power supply 3 is corrected to control the preheating amount. That is, when the preheating amount must be reduced, the voltage E of the DC power supply 3 is corrected in the downward direction. When the preheating amount must be increased, the voltage E of the DC power supply 3 is corrected in the upward direction.

Figure 22:
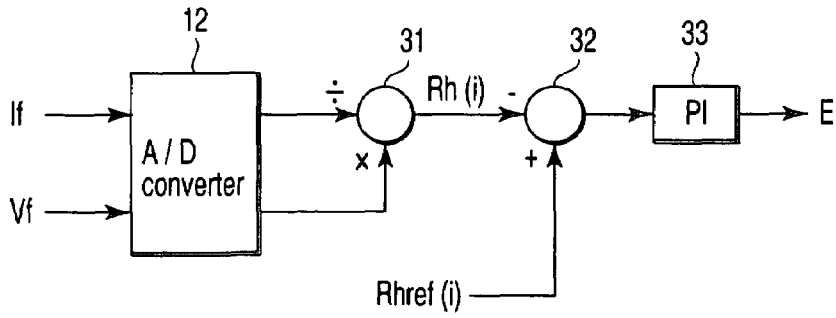
FIG. 22 shows a sequence pattern of program processing of the ninth embodiment.

FIG. 22 shows a sequence pattern of program processing in the CPU 131. In place of the proportional-plus-integral control means 33 of the fifth embodiment, proportional-plus-integral control means 33*a* is adopted. The proportional-plus-integral control means 33*a* finds voltage E that brings the reduction result of the computing means 32 closer to zero.

Other configuration, function, and effects are same as those of the fifth embodiment. Consequently, the description will be omitted.

[10] Description will be made on a tenth embodiment of the present invention. The tenth embodiment is a modification of the sixth embodiment described above.

Figure 23:
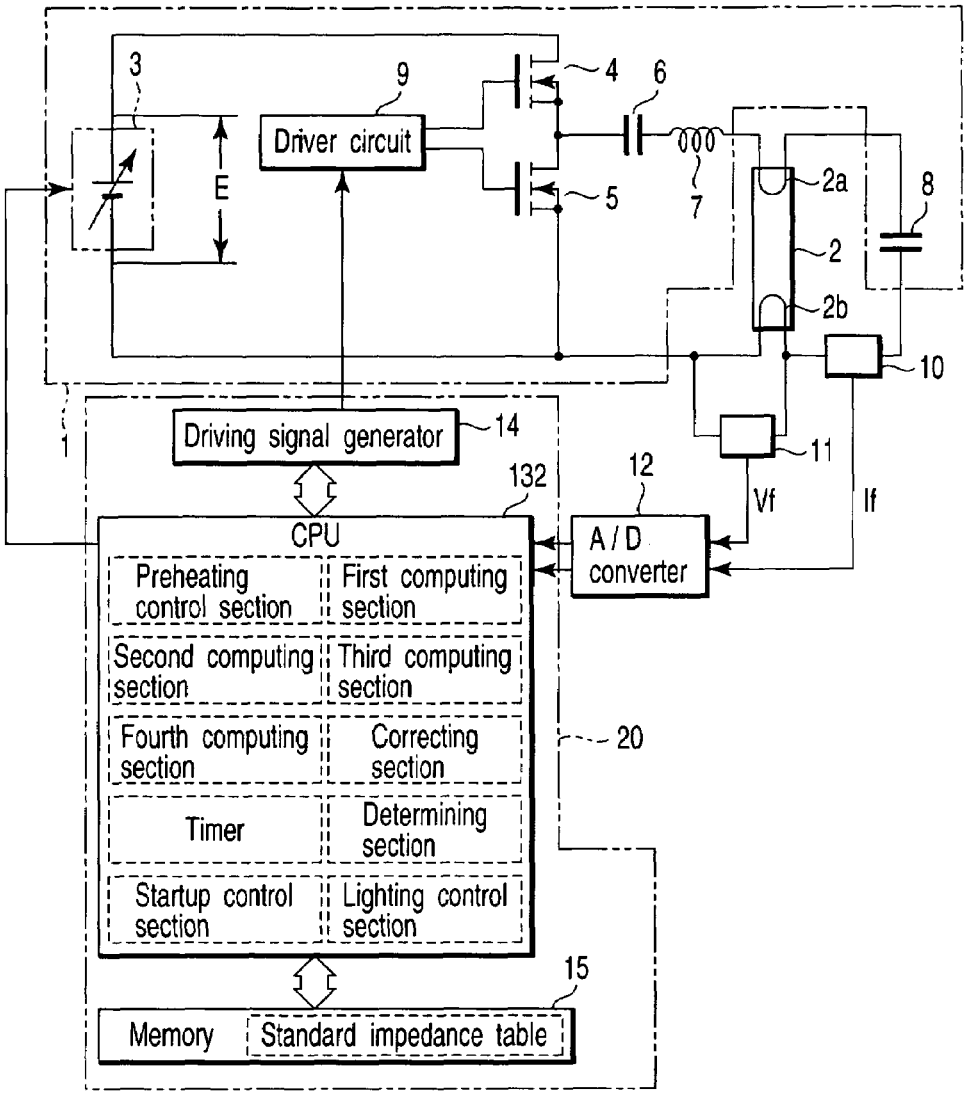
FIG. 23 shows a configuration of a tenth embodiment.

As shown in FIG. 23, voltage E of the DC power supply 3 of the high-frequency generating circuit 1 is controlled by the CPU 132 of the controller 20.

Of all sections of the CPU 132, the correcting section only differs from the sixth embodiment. In the sixth embodiment, the level for preheating (=switching frequency f) is corrected to control the preheating amount, but in this tenth embodiment, the voltage E of the DC power supply 3 is corrected to control the preheating amount. That is, when the preheating amount must be reduced, the voltage E of the DC power supply 3 is corrected in the downward direction. When the preheating amount must be increased, the voltage E of the DC power supply 3 is corrected in the upward direction.

Figure 24:
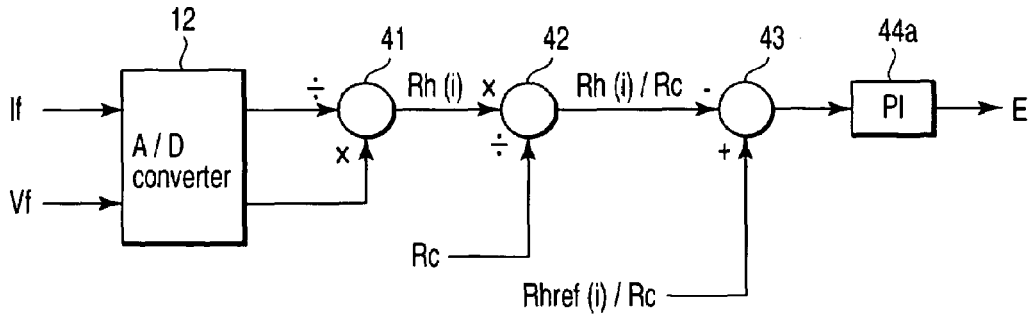
FIG. 24 shows a sequence pattern of program processing of the tenth embodiment.

FIG. 24 shows a sequence pattern of program processing in the CPU 132. In place of the proportional-plus-integral control means 44 of the sixth embodiment, proportional-plus-integral control means 44*a* is adopted. The proportional-plus-integral control means 44*a* finds voltage E that brings the reduction result of the computing means 43 closer to zero.

Other configuration, function, and effects are same as those of the sixth embodiment. Consequently, the description will be omitted.

[11] Description will be made on an eleventh embodiment of the present invention. The eleventh embodiment is a modification of the seventh embodiment described above.

Figure 25:
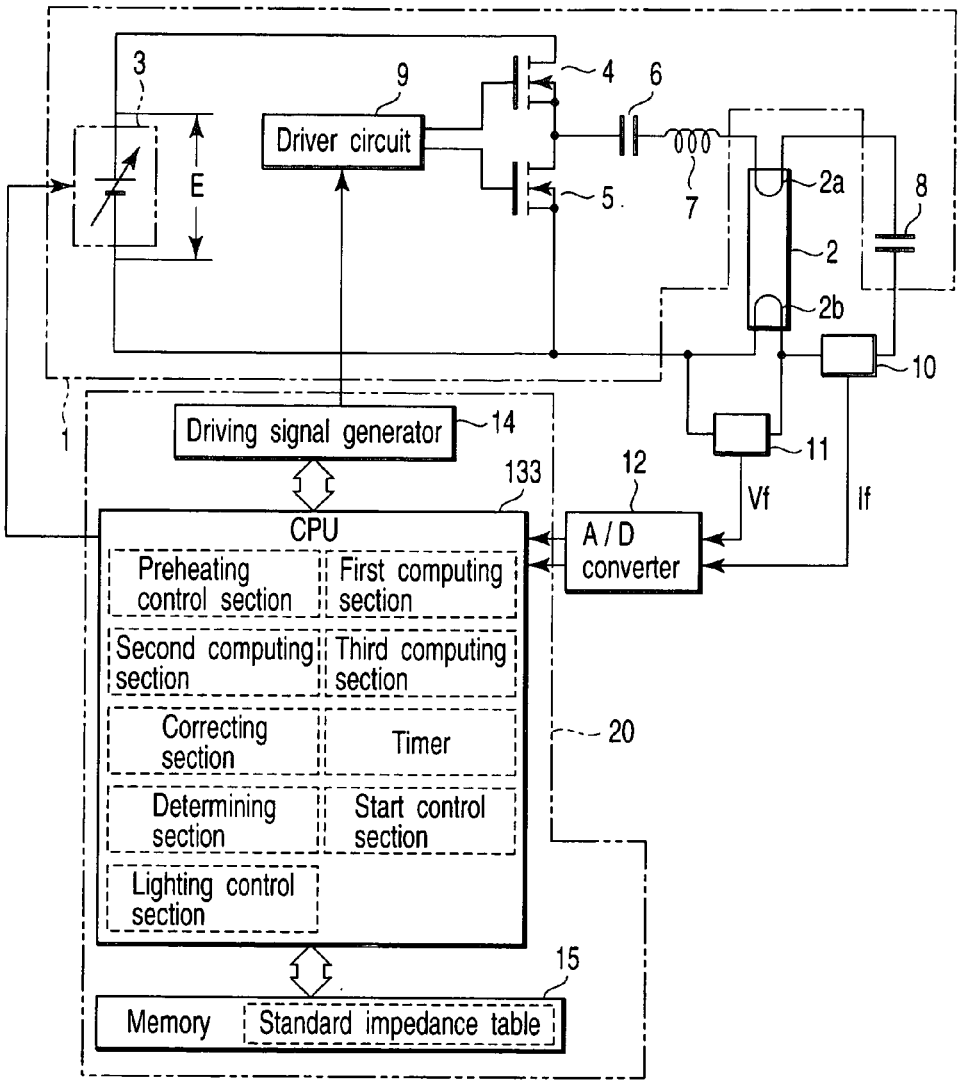
FIG. 25 shows a configuration of an eleventh embodiment.

As shown in FIG. 25, voltage E of the DC power supply 3 of the high-frequency generating circuit 1 is controlled by the CPU 133 of the controller 20.

Of all sections of the CPU 133, the correcting section only differs from the seventh embodiment. In the seventh embodiment, the level for preheating (=switching frequency f) is corrected to control the preheating amount, but in this eleventh embodiment, the voltage E of the DC power supply 3 is corrected to control the preheating amount. That is, when the preheating amount must be reduced, the voltage E of the DC power supply 3 is corrected in the downward direction. When the preheating amount must be increased, the voltage E of the DC power supply 3 is corrected in the upward direction.

Figure 26:
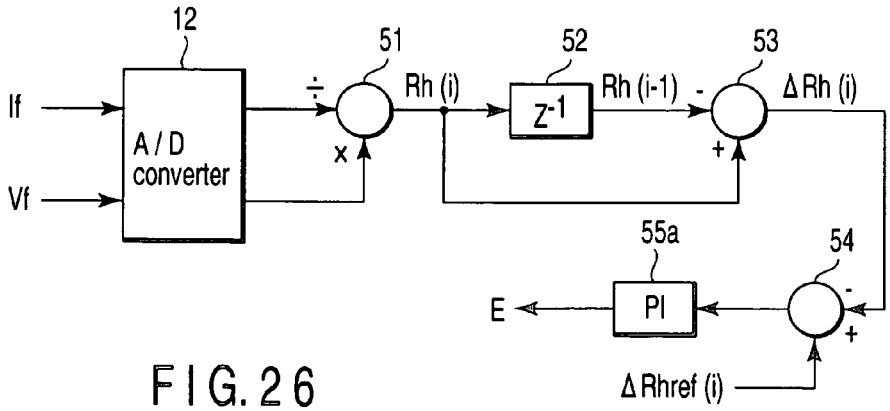
FIG. 26 shows a sequence pattern of program processing of the eleventh embodiment.

FIG. 26 shows a sequence pattern of program processing in the CPU 133. In place of the proportional-plus-integral control means 55 of the seventh embodiment, proportional-plus-integral control means 55*a* is adopted. The proportional-plus-integral control means 55*a* finds voltage E that brings the reduction result of the computing means 54 closer to zero.

Other configuration, function, and effects are same as those of the seventh embodiment. Consequently, the description will be omitted.

[12] Description will be made on a twelfth embodiment of the present invention. The twelfth embodiment is a modification of the eighth embodiment described above.

Figure 27:
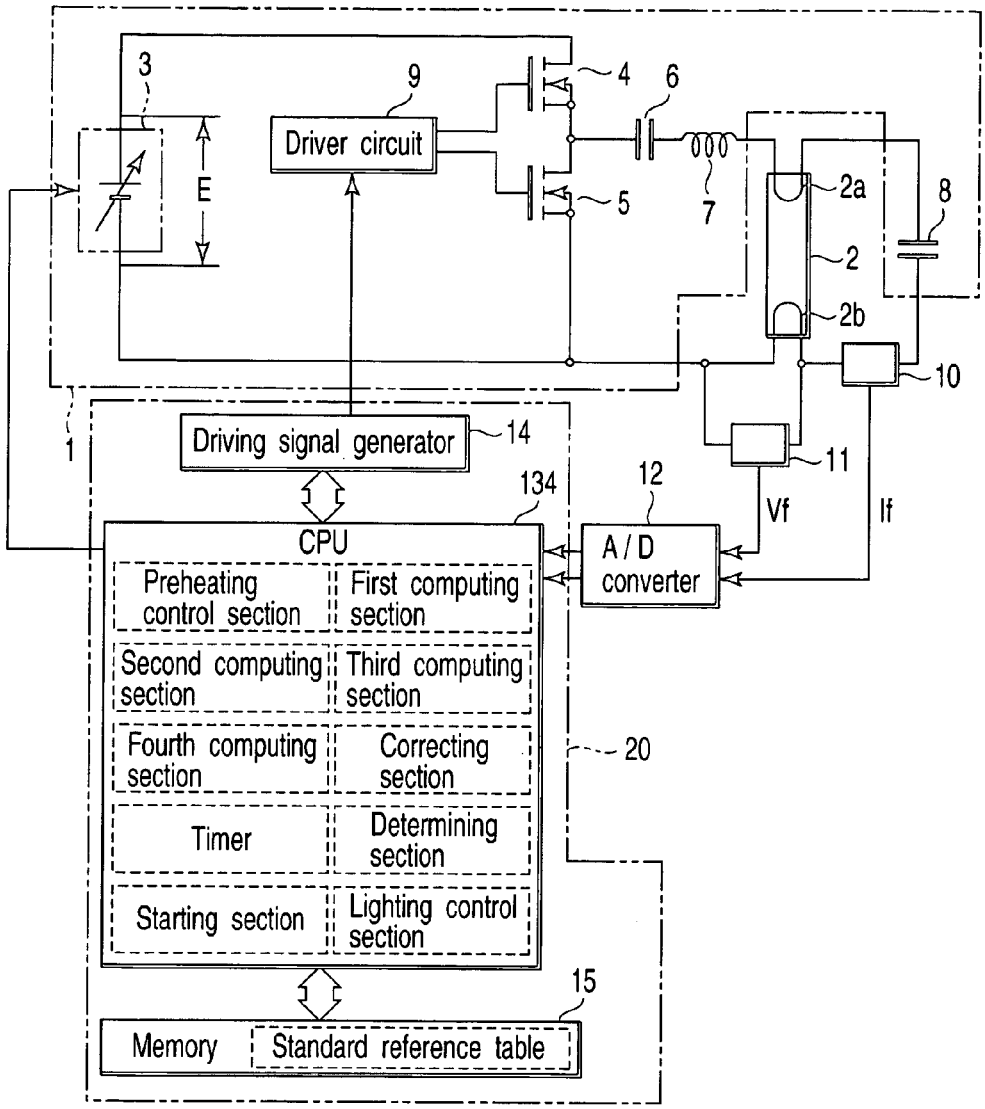
FIG. 27 shows a configuration of a twelfth embodiment.

As shown in FIG. 27, voltage E of the DC power supply 3 of the high-frequency generating circuit 1 is controlled by the CPU 134 of the controller 20.

Of all sections of the CPU 134, the correcting section only differs from the eighth embodiment. In the eighth embodiment, the level for preheating (=switching frequency f) is corrected to control the preheating amount, but in this twelfth embodiment, the voltage E of the DC power supply 3 is corrected to control the preheating amount. That is, when the preheating amount must be reduced, the voltage E of the DC power supply 3 is corrected in the downward direction. When the preheating amount must be increased, the voltage E of the DC power supply 3 is corrected in the upward direction.

Figure 28:
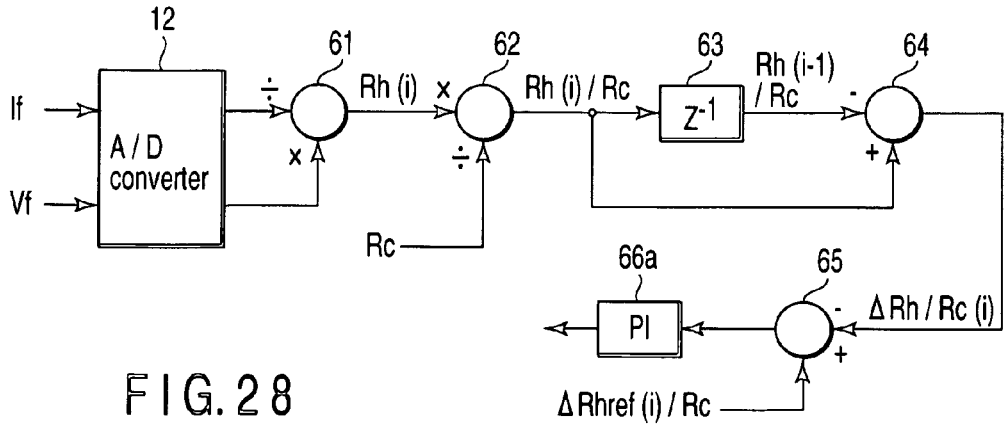
FIG. 28 shows a sequence pattern of program processing of the twelfth embodiment.

FIG. 28 shows a sequence pattern of program processing in the CPU 134. In place of the proportional-plus-integral control means 66 of the eighth embodiment, proportional-plus-integral control means 66*a* is adopted. The proportional-plus-integral control means 66*a* finds voltage E that brings the reduction result of the computing means 65 closer to zero.

Other configuration, function, and effects are same as those of the eighth embodiment. Consequently, the description will be omitted.

[13] A thirteenth embodiment of the present invention is described as follows.

Figure 29:
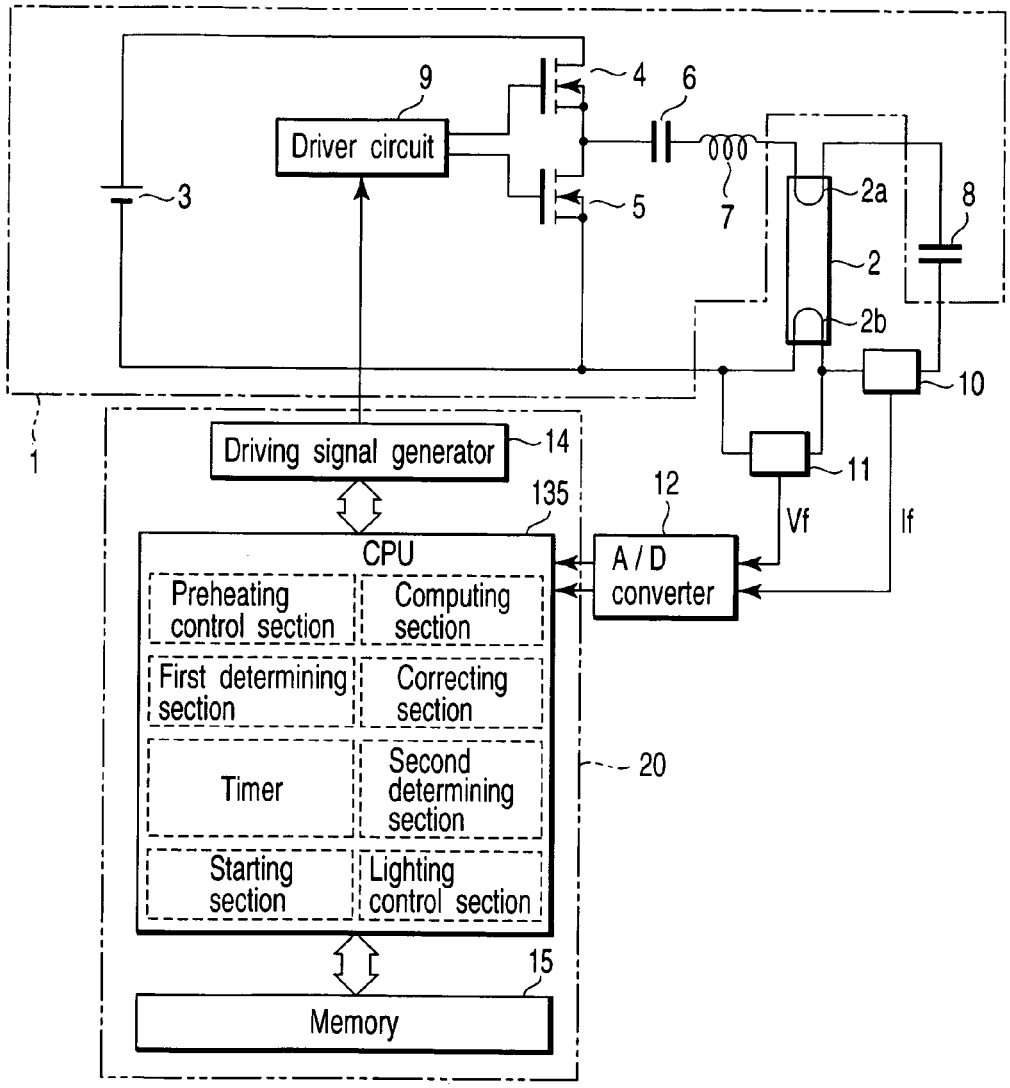
FIG. 29 shows a configuration of a thirteenth embodiment.

In place of the CPU 13 of the first embodiment, a CPU 135 is adopted as shown in FIG. 29. The CPU 135 has the following sections (1) to (8) as main functions.

(1) A preheat control section that sets the output voltage of the high-frequency generating circuit 1 to a level for preheating and allows preheat current to flow in filament electrodes 2*a*, 2*b* of the discharge lamp 2.

(2) A computing section that imports preheat current If and detecting voltage Vf digital-converted by the A/D converter 12 and computes the impedance Rh of the filament electrode 2*b* of the discharge lamp 2 from the imported preheat current If and detecting voltage Vf at the time of preheating by the preheat control section every predetermined time. Note that the impedance Rh computed every predetermined time is designated as the impedance Rh(i).

(3) A first determining section that determines whether or not the computed impedance Rh(i) has reached the preliminarily defined setting RhA every time the impedance Rh(i) is computed at the computing section at the time of preheating by the preheating section.

(4) A correcting section that corrects the level for preheating (=switching frequency f) so that the positive state is maintained when the determination result of the first determining section becomes positive.

(5) A timer that counts the elapsed time t from the start of preheating by the preheating control section.

(6) A second determining section that determines whether or not the timer count time t has reached the preliminarily defined preheating time Tph.

(7) A start control section switches the output voltage of the high-frequency generating circuit 1 to the preliminarily defined level for starting from the level for preheating so that the discharge lamp 2 is lighted when the determination results of the determining section become positive.

(8) A lighting control section that sets the output voltage of the high-frequency generating circuit 1 to the preliminarily defined level for lighting in order to maintain lighting of the discharge lamp 2 by the start control section.

The function is described as follows.

At the time of preheating, every time the impedance Rh(i) is computed, the computed impedance Rh(i) is determined as to whether or not the computed impedance Rh(i) has reached the preliminarily defined setting RhA.

Figure 30:
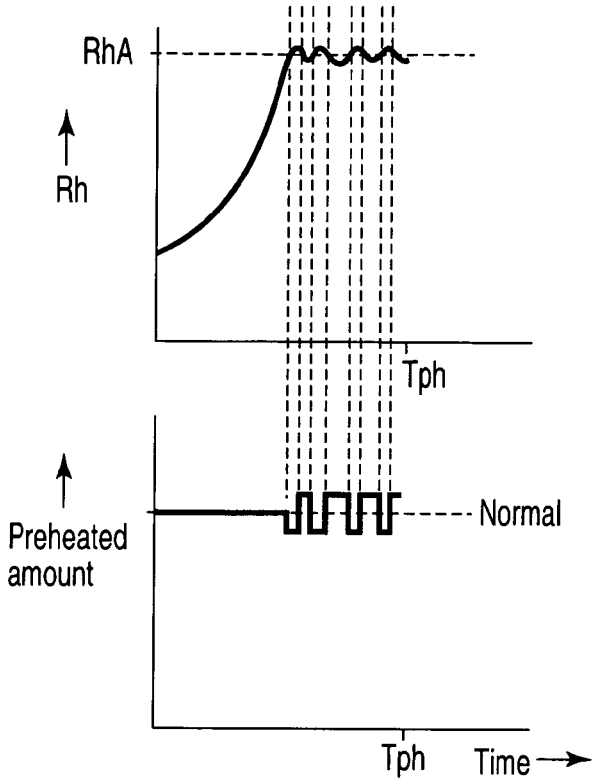
FIG. 30 shows changes of computation impedance and changes of preheated amount in the twelfth embodiment.

As shown in FIG. 30, when the impedance Rh(i) reaches the setting RhA, the level for preheating (=switching frequency f) is corrected in such a manner that the state is maintained.

From the start of preheating, the elapsed time t is counted by the timer and in the timing for the count time t to reach the preheating time Tph, the output voltage of the high-frequency generating circuit 1 is switched from the level for preheating to the level for starting.

Other configuration, function, and effects are same as those of the first embodiment. Consequently, the description will be omitted.

[14] Description is made on a fourteenth embodiment of the present invention.

Figure 31:
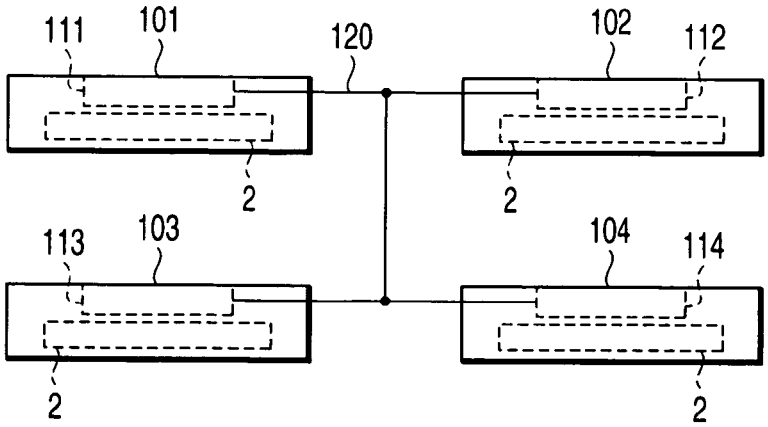
FIG. 31 shows a general configuration of a fourteenth embodiment.

As shown in FIG. 31, one lighting system is composed with a group of a plurality of lighting apparatus 101, 102, 103, and 104. The lighting apparatus 101 is used as a host which is the nucleus of control.

The lighting apparatus 101 has a discharge lamp 2 and has a discharge lamp lighting device 111 to preheat and light the discharge lamp 2. The lighting apparatus 102, 103, and 104 have the discharge lamp 2 and have the discharge lamp lighting devices 112, 113, and 114.

Figure 32:
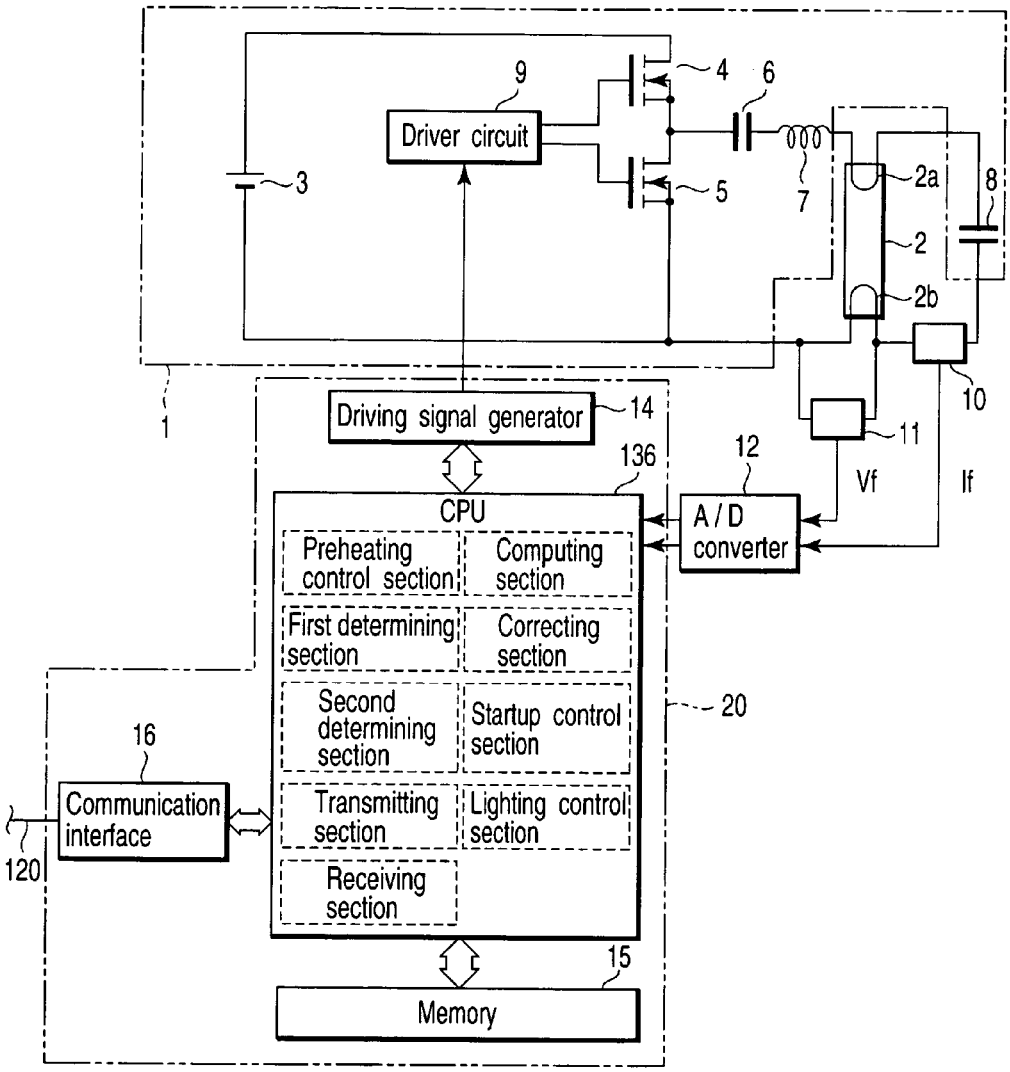
FIG. 32 shows a configuration of a discharge lamp lighting device of first lighting device in the fourteenth embodiment.
Figure 33:
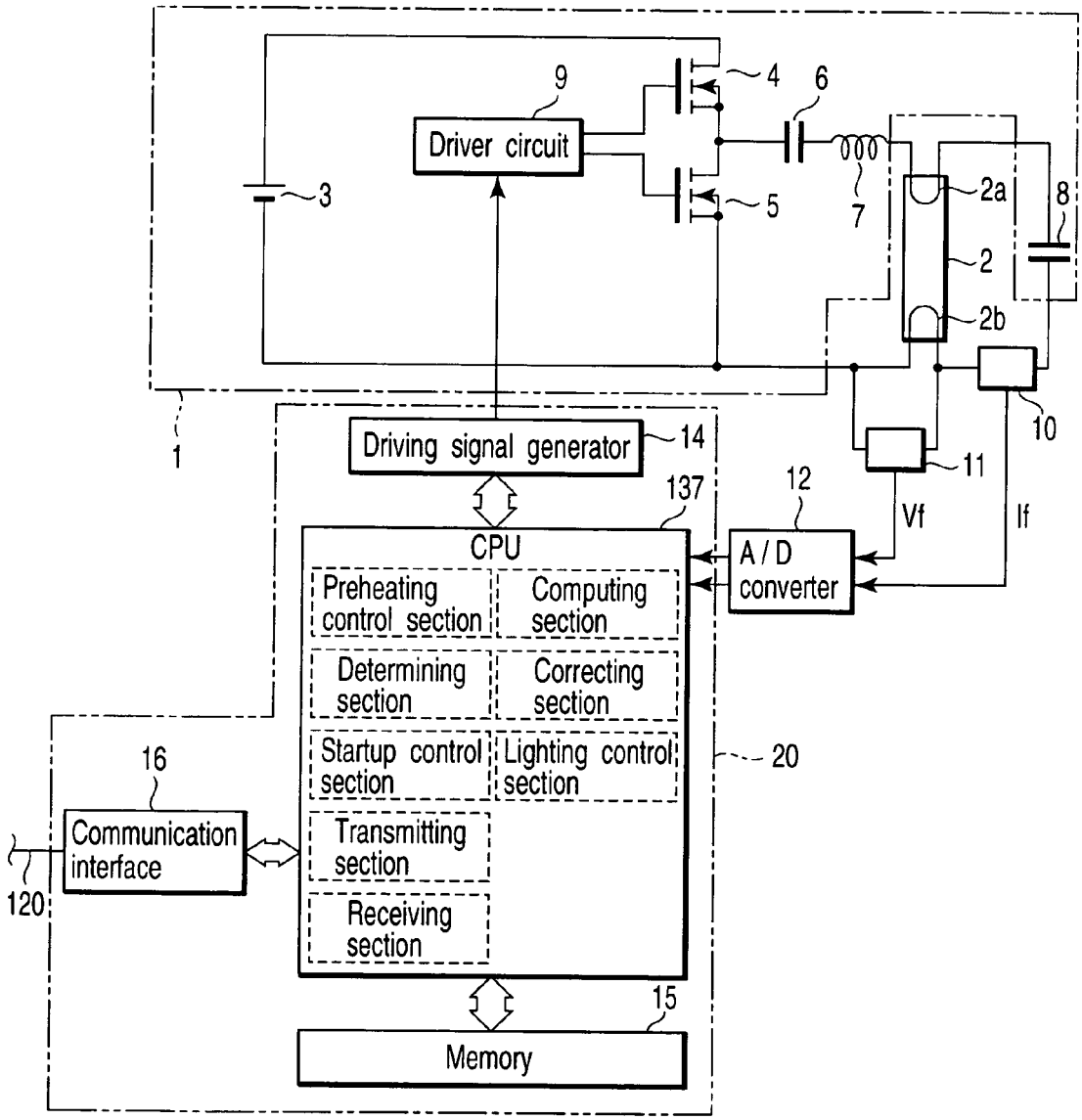
FIG. 33 shows a configuration of a discharge lamp lighting device of second lighting device in the fourteenth embodiment.

FIG. 32 shows the configuration of the discharge lamp lighting device 111 of the lighting apparatus 101. FIG. 33 shows the configuration of remaining discharge lamp lighting devices 112, 113, and 114. The discharge lamp lighting devices 111, 112, 113, and 114 have a controller 20, respectively. By these controllers 20, a control section is configured in such a manner as to execute switching from preheating of each discharge lamp 2 to lighting when all the impedances Rh of filament electrodes 2*b* in all discharge lamps 2 reach the preliminarily defined setting RhA.

First of all, the controller 20 of the discharge lamp lighting device 111 shown in FIG. 32 comprises a driving signal generator 14, a memory 15, a communication interface 16, and a CPU 136. The communication interface 16 is connected to each of the controllers 20 of the discharge lamp lighting devices 112, 113, and 114 via the communication line 120.

The CPU 136 is equipped with the following sections (1) to (9) as the main functions.

(1) A preheat control section that sets the output voltage of the high-frequency generating circuit 1 to a level for preheating and allows preheat current to flow in filament electrodes 2*a*, 2*b* of the discharge lamp 2 (first preheat control section).

(2). A computing section that computes the impedance Rh of the filament electrode 2*b* of the discharge lamp 2 from the preheating current detected by the current detector 10 and the detecting voltage of the voltage detector 11.

(3) A receiving section that receives the computation results (impedance Rh) transmitted from other lighting apparatus 102, 103, and 104 via the communication interface 16.

(4) A first determining section that determines whether or not the computed impedance Rh has reached the preliminarily defined setting RhA every time the impedance Rh is computed at the computing section at the time of preheating by the preheating section.

(5) A correcting section that corrects the level for preheating (=switching frequency f) so that the positive state is maintained when the determination result of the first determining section becomes positive.

(6) A second determining section that determines whether or not the computation results received by the receiving section and all the computation results of the computing section have reached the preliminarily defined preheating time RhA.

(7) A transmitting section that transmits switching commands to other lighting apparatus 102, 103, and 104 via the communication interface 16 when the determination results of the second determining section are positive.

(8) A start control section that switches the output voltage of the high-frequency generating circuit 1 to the preliminarily defined level for starting from the level for preheating so that the discharge lamp 2 is lighted when the determination results of the second determining section become positive.

(9) A lighting control section that switches the output voltage of the high-frequency generating circuit 1 from the level for starting to the preliminarily defined level for lighting in order to maintain lighting of the discharge lamp 2 by the start control section.

On the other hand, the controllers 20 of the lighting devices 112, 113, and 114 shown in FIG. 33 comprises the driving signal generator 14, memory 15, communication interface 16, and CPU 137. The communication interface 16 is connected to the controller 20 of the discharge lamp lighting device 111 via the communication line 120.

The CPU 137 is equipped with the following sections (1) to (8) as the main functions.

(1) A preheat control section that sets the output voltage of the high-frequency generating circuit 1 to a level for preheating and allows preheat current to flow in filament electrodes 2*a*, 2*b* of the discharge lamp 2.

(2) A computing section that computes the impedance Rh of the filament electrode 2*b* of the discharge lamp 2 from the preheating current detected by the current detector 10 and the detecting voltage of the voltage detector 11.

(3) A transmitting section that transmits computation results of the computing section to the host lighting apparatus 101 via the communication interface 16.

(4) A determining section that determines whether or not the computed impedance Rh has reached the preliminarily defined setting RhA every time the impedance Rh is computed at the computing section.

(5) A correcting section that corrects the level for preheating (=switching frequency f) so that the positive state is maintained when the determination result of the first determining section becomes positive.

(6) A receiving section that receives the switching commands transmitted from the lighting apparatus 101 via the communication interface 16.

(7) A start control section that switches the output voltage of the high-frequency generating circuit 1 to the preliminarily defined level for starting from the level for preheating so that the discharge lamp 2 is lighted when the switching command is received at the receiving section.

(8) A lighting control section that switches the output voltage of the high-frequency generating circuit 1 from the level for starting to the preliminarily defined level for lighting in order to maintain lighting of the discharge lamp 2 by the start control section.

In this kind of lighting system, by turning ON the power supply of lighting apparatus 101, 102, 103, and 104 concurrently, preheating control is started concurrently in discharge lamp lighting devices 111, 112, 113 and 114. When all the impedances Rh of filament electrodes 2*b* in all the discharge lamps 2 reach the setting RhA, all the discharge lamps 2 are switched from preheating to lighting concurrently.

Consequently, the time until the relevant discharge lamps 2 of the lighting apparatus 101, 102, 103, and 104 is steadily maintained to the constant state. In addition, in each controller 20, a timer is no longer required.

Figure 34:
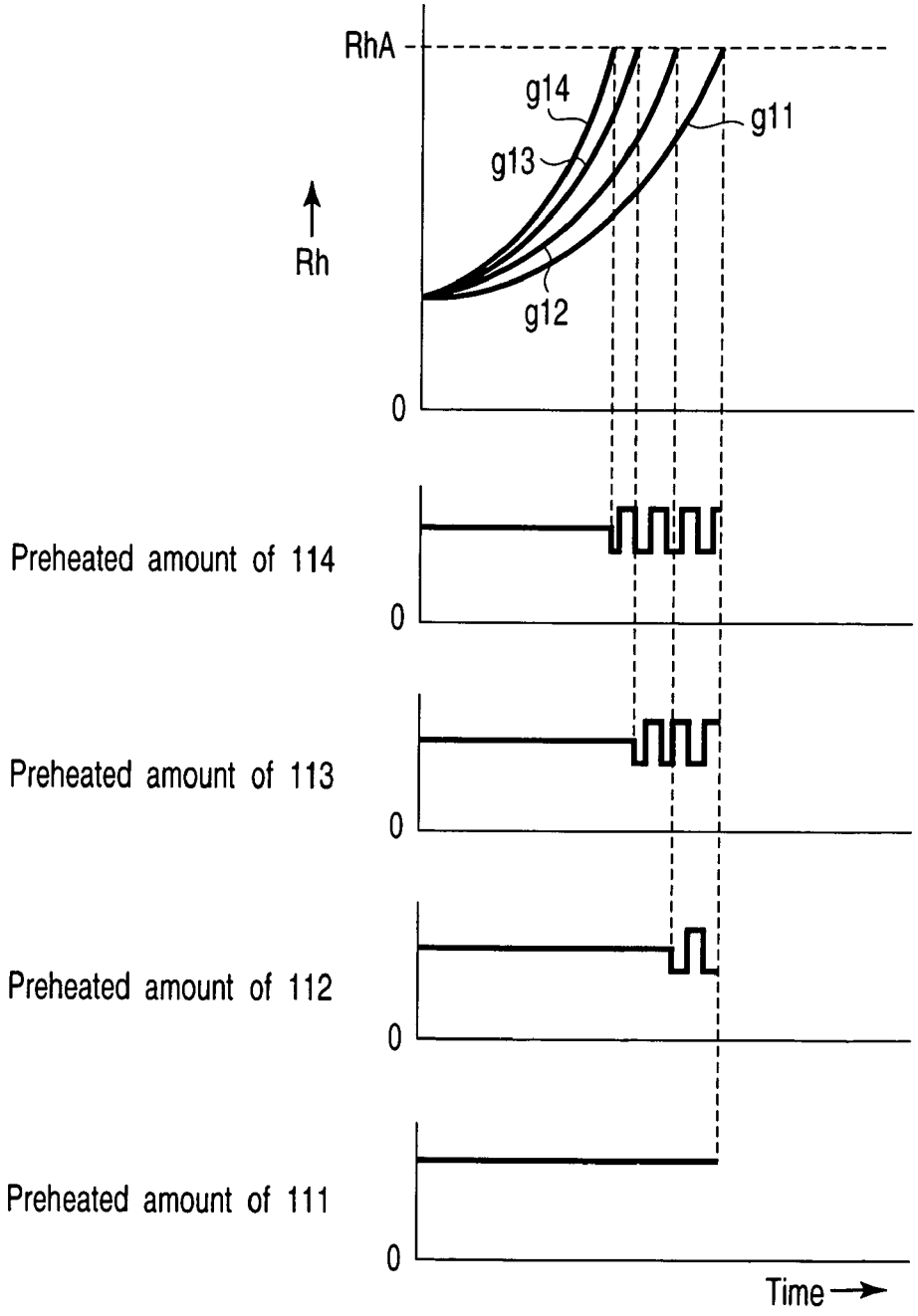
FIG. 34 shows changes in computed impedance and preheated amount in each lighting device of the fourteenth embodiment.

FIG. 34 shows the change of the impedance Rh computed by discharge lamp lighting devices 111, 112, 113, and 114 and how the preheating amount of discharge lamp lighting devices 111, 112, 113, and 114 is controlled. In this example, the impedance Rh computed by the discharge lamp lighting device 114 is the first to reach the setting RhA as shown in the pattern g14 and the impedance Rh computed by the discharge lamp lighting device 111 is the last to reach the setting RhA as shown in the pattern g11. Consequently, control to maintain the preheating amount in the discharge lamp lighting devices 114, 113, and 112 is continued, respectively, until the impedance Rh computed by the discharge lamp lighting device 111 reaches the setting RhA.

Other configuration, function, and effects are same as those of the first embodiment. Consequently, the description will be omitted.

Incidentally, communication between controllers 20 may not be limited to the wired type but may be the wireless type. In addition, the impedance Rh, the computation result, is transmitted from discharge lamp lighting devices 112, 113, and 114 to the discharge lamp lighting device 111 and whether or not all the impedances Rh have reached the setting RhA is determined by the host discharge lamp lighting device 111. However, since the discharge lamp lighting devices 112, 113, and 114 are equipped with a determining section that determines whether the impedance Rh has reached the setting RhA, the system may be configured to transmit the determination results of the discharge lamp lighting devices 112, 113, and 114 to the discharge lamp lighting device 111.

The lighting apparatus 101 is used as a host, which is the nucleus of control, but a terminal for control may be installed separately from the lighting apparatus 101, 102, 103, and 104 so that the system may be configured to control all the lighting apparatus by the terminal.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A discharge lamp lighting device, comprising:

a high-frequency generating circuit which outputs high-frequency voltage;

a discharge lamp having a pair of filament electrodes, the discharge lamp being lighted by the high-frequency voltage applied across the filament electrodes;

a current detector detecting preheat current which flows through the filament electrodes of the discharge lamp;

a voltage detector which detects voltage generated in either one filament electrode of the pair of filament electrodes; and a controller which computes impedance of either one of the filament electrodes from the preheat current detected by the current detector and the detecting voltage of the voltage detector, and controls to preheat and light the discharge lamp in accordance with the computed impedance.

2. The discharge lamp lighting device according to claim 1, wherein the controller comprises:

a preheating control section which sets the output voltage of the high-frequency generating circuit to a level for preheating and allows the preheat current to each filament electrode of the discharge lamp;

a computing section which computes impedance of either of the filament electrodes from the preheat current detected by the current detector and the detecting voltage of the voltage detector at the time of preheating by the preheating control section;

a determining section which determines whether or not the impedance computed by the computing section has reached the preliminarily defined setting;

a startup control section which switches the output voltage of the high-frequency generating circuit from the level for heating to the preliminarily defined level for lighting in order to light the discharge lamp when the determination result of the determining section becomes positive;

a lighting control section which switches the output voltage of the high frequency generating circuit from the level for starting to a preliminarily defined level for lighting in order to maintain lighting of the discharge lamp by the startup control section;

a timer which counts the elapsed time from starting preheating by the preheating control section to obtaining a positive determination result of the determining section; and a correcting section which corrects the level for heating in accordance with the timer count time in the next preheating by the preheating control section.

3. The discharge lamp lighting device according to claim 2, wherein the correcting section corrects the level for preheating in such a manner as to come close to the reference time in which the timer count time is preliminarily defined in the next preheating by the preheating control section.

4. The discharge lamp lighting device according to claim 3, wherein the correcting section reduces the level for preheating when the timer count time is shorter than the reference time, increases when the timer count time is longer than the reference time, and holds when the timer count time is same as the reference time in the next preheating by the preheating control section.

5. The discharge lamp lighting device according to claim 3, wherein the correcting section increases and reduces the level for preheating for the amount that corresponds to the difference between the timer count time and the reference time in the next preheating by the preheating control section.

6. The discharge lamp lighting device according to claim 2, the controller further comprising a protection section, wherein the protection section stops the preheating by the preheating control section when the preheat current detected by the current detector is zero over the time exceeding the preliminarily defined time setting or is zero when the detecting voltage of the voltage detector is zero over the time exceeding the time setting in preheating by the preheating control section.

7. The discharge lamp lighting device according to claim 6, the controller further comprising an annunciating section, wherein the annunciating section determines the abnormality and annunciates the abnormality when the preheat current detected by the current detector is zero over the time exceeding the preliminarily defined time setting or when the detecting voltage of the voltage detector is zero over the time exceeding the time setting in preheating by the preheating control section.

8. The discharge lamp lighting device according to claim 2, wherein the high-frequency generating circuit comprises a DC power supply, a resonance circuit comprising a capacitor and coil connected to the DC power supply, and one or more switching elements which energize the resonance circuit, and generates high-frequency voltage by turning ON and OFF the switching element.

9. The discharge lamp lighting device according to claim 8, wherein the preheating control section drives ON and OFF the switching element of the high-frequency generating circuit to preheat the discharge lamp at a frequency that corresponds to the preliminarily defined preheating level, and the correcting section corrects the frequency of the turning ON and Off in such a manner as to come close to the reference time in which the timer count time is preliminarily defined in the next preheating by the preheating control section.

10. The discharge lamp lighting device according to claim 8, wherein the preheating control section drives ON and OFF the switching element to preheat the discharge lamp at a frequency that corresponds to the preliminarily defined preheating level, and the correcting section increases and reduces the ON and OFF-driven frequency for the amount that corresponds to the difference between the timer count time and the reference time in the next preheating by the preheating control section.

11. The discharge lamp lighting device according to claim 1, wherein the controller, comprising:

a preheating control section which controls the output voltage of the high-frequency generating circuit and allows the preheat current to each filament electrode of the discharge lamp so that the preheat current detected by the current detector achieves the desired level;

a computing section which computes impedance of either of the filament electrodes from the preheat current detected by the current detector and the detecting voltage of the voltage detector at the time of preheating by the preheating control section;

a determining section which determines whether or not the impedance computed by the computing section has reached the preliminarily defined setting;

a startup control section which switches the output voltage of the high-frequency generating circuit from the level for heating to the preliminarily defined level for lighting in order to light the discharge lamp when the determination result of the determining section becomes positive;

a lighting control section which changes the output voltage of the high frequency generating circuit from the level for starting to a preliminarily defined level for lighting in order to maintain lighting of the discharge lamp by the startup control section;

a timer which counts the elapsed time from starting preheating by the preheating control section to obtaining a positive determination result of the determining section; and a correcting section which corrects the desired level for heating in accordance with the timer count time in the next preheating by the preheating control section.

12. The discharge lamp lighting device according to claim 1, wherein the controller comprises:

a preheating control section which sets the output voltage of the high-frequency generating circuit to a level for preheating and allows the preheat current to each filament electrode of the discharge lamp;

a computing section which computes impedance of either of the filament electrodes from the detecting current of the current detector and the detecting voltage of the voltage detector at regular time intervals at the time of preheating by the preheating control section;

a standard impedance table which stores a plurality of standard impedances preset stepwise in accordance with the computation at regular time intervals of the computing section;

a comparing section which compares the computed impedance to the standard impedance in the standard impedance table that correspond to the computation every time the impedance is computed by the computing section at the time of preheating by the preheating section;

a correcting section which corrects the level for preheating in accordance with the comparison results every time the comparing section compares the impedance;

a timer which counts the elapsed time from the start of preheating by the preheating control section;

a determining section which determines whether or not the count time of the timer has reached the preliminarily defined preheating time;

a startup control section which switches the output voltage of the high-frequency generating circuit from the level for heating to the preliminarily defined level for lighting in order to light the discharge lamp when the determination result of the determining section becomes positive; and a lighting control section which changes the output voltage of the high frequency generating circuit from the level for starting to a preliminarily defined level for lighting in order to maintain lighting of the discharge lamp by the startup control section.

13. The discharge lamp lighting device according to claim 1, wherein the controller comprises:

a preheating control section which sets the output voltage of the high-frequency generating circuit to a level for preheating and allows the preheat current to each filament electrode of the discharge lamp;

a first computing section which computes impedance Rh(i) of either of the filament electrodes from the detecting current of the current detector and the detecting voltage of the voltage detector at regular time intervals at the time of preheating by the preheating control section;

a storage section which stores the impedance Rh(i) first computed at the first computing section as the desired impedance Rc;

a standard impedance table which stores a plurality of standard impedances Rhref(i) preset stepwise in accordance with the computation at regular time intervals of the computing section;

a second computing section which computes a ratio (Rhref(i)/Rh(i)) of a standard impedance Rhref(i) in the standard impedance table that corresponds to the computation to the stored desired impedance Rc every time the impedance Rh(i) is computed in the first computing section at the time of preheating by the preheating control section;

a third computing section which computes a ratio (Rh(i)/Rc) of the computed impedance Rh(i) to the stored desired impedance Rc every time the impedance Rh(i) is computed by the first computing section at the time of heating by the preheating control section;

a fourth computing section which computes a difference [(Rhref(i)/Rh(i))−(Rh(i)/Rc)] between the ratio (Rhref(i)/Rh(i)) computed in the second computing section and the ratio (Rh(i)/Rc) computed in the third computing section;

a correcting section which corrects the level for preheating in the direction in which the difference [(Rhref(i)/Rh(i))−(Rh(i)/Rc)] computed by the fourth computing section becomes zero;

a timer which counts the elapsed time from the start of preheating by the preheating control section;

a determining section which determines whether or not the count time of the timer has reached the preliminarily defined preheating time;

a startup control section which switches the output voltage of the high-frequency generating circuit from the level for heating to the preliminarily defined level for lighting in order to light the discharge lamp when the determination result of the determining section becomes positive; and a lighting control section which changes the output voltage of the high frequency generating circuit from the level for starting to a preliminarily defined level for lighting in order to maintain lighting of the discharge lamp by the startup control section.

14. The discharge lamp lighting device according to claim 1, wherein the controller comprises:

a preheating control section which sets the output voltage of a high-frequency generating circuit to a level for preheating and allows the preheat current to each filament electrode of the discharge lamp;

a first computing section which computes impedance Rh(i) of either of the filament electrodes from the detecting current of the current detector and the detecting voltage of the voltage detector at regular time intervals at the time of preheating by the preheating control section;

a second computing section which computes an impedance difference ΔRh(i) between the computed impedance Rh(i) and the last computed impedance Rh(i−1) every time the impedance Rh(i) is computed by the first computing section at the time of preheating by the preheating control section;

a standard impedance table which stores a plurality of standard impedances Rhref(i) preset stepwise in accordance with each computation of the second computing section;

a third computing section which computes a difference [ΔRhref(i)−ΔRh(i)] between the computed impedance difference ΔRh(i) and the standard impedance difference ΔRhref(i) in the standard impedance table that corresponds to the computation every time the impedance difference ΔRh(i) is computed at the second computing section at the time of preheating by the preheating control section;

a correcting section which corrects the level for preheating in the direction in which the [ΔRhref(i)−ΔRh(i)] computed by the third computing section becomes zero;

a timer which counts the elapsed time from the start of preheating by the preheating control section;

a determining section which determines whether or not the count time of the timer has reached the preliminarily defined preheating time;

a startup control section which switches the output voltage of the high-frequency generating circuit from the level for heating to the preliminarily defined level for lighting in order to light the discharge lamp when the determination result of the determining section becomes positive; and a lighting control section which changes the output voltage of the high frequency generating circuit from the level for starting to a preliminarily defined level for lighting in order to maintain lighting of the discharge lamp by the startup control section.

15. The discharge lamp lighting device according to claim 1, wherein the controller comprises:

a preheating control section which sets the output voltage of the high-frequency generating circuit to a level for preheating and allows the preheat current to each filament electrode of the discharge lamp;

a first computing section which computes impedance Rh(i) of either of the filament electrodes from the detecting current of the current detector and the detecting voltage of the voltage detector at regular time intervals at the time of preheating by the preheating control section;

a storage section which stores the impedance Rh(i) first computed at the first computing section as the desired impedance Rc;

a second computing section which computes a ratio (Rh(i)/Rc) of the impedance Rh(i) computed every time the impedance Rh(i) is computed in the first computing section at the time of preheating by the preheating control section to the stored desired impedance Rc;

a third computing section which computes the difference Δ(Rh(i)/Rc)[=(Rh(i)/Rc)−(Rh(i−1)/Rc)] between the impedance Rh(i) computed every time the ratio (Rh(i)/Rc) is computed in the second computing section at the time of preheating by the preheating control section to the last ratio (Rh(i−1)/Rc) computed by the second computing means;

a standard difference table which stores a plurality of standard differences Δ(Rhref(i)/Rc) preset stepwise in accordance with each computation at the third computing section;

a fourth computing section which computes a difference [Δ(Rhref(i)/Rc)−Δ(Rh(i)/Rc)] between the computed difference Δ(Rh(i)/Rc) and the standard difference Δ(Rhref(i)/Rc) in the standard difference table that corresponds to the computation every time the difference Δ(Rh(i)/Rc) is computed at the third computing section at the time of preheating by the preheating control section;

a correcting section which corrects the level for preheating in the direction in which the difference [Δ(Rhref(i)/Rc)−Δ(Rh(i)/Rc)] computed by the fourth computing section becomes zero;

a timer which counts the elapsed time from the start of preheating by the preheating control section;

a determining section which determines whether or not the count time of the timer has reached the preliminarily defined preheating time;

a startup control section which switches the output voltage of the high-frequency generating circuit from the level for heating to the preliminarily defined level for lighting in order to light the discharge lamp when the determination result of the determining section becomes positive; and a lighting control section which changes the output voltage of the high frequency generating circuit from the level for starting to a preliminarily defined level for lighting in order to maintain lighting of the discharge lamp by the startup control section.

16. The discharge lamp lighting device according to claim 1, wherein the controller comprises:

a preheating control section which sets the output voltage of the high-frequency generating circuit to a level for preheating and allows the preheat current to each filament electrode of the discharge lamp;

a computing section which computes impedance of either of the filament electrodes from the detecting current of the current detector and the detecting voltage of the voltage detector at regular time intervals at the time of preheating by the preheating control section;

a first determining section which determines whether or not the computed impedance has reached the preliminarily defined setting every time the impedance is computed in the computing section at the time of preheating by the preheating control section;

a correcting section which corrects the level for preheating in such a manner that the positive status is maintained when the determination result of the first determining section becomes positive;

a timer which counts the elapsed time from the start of preheating by the preheating control section;

a second determining section which determines whether or not the count time of the timer has reached the preliminarily defined preheating time;

a startup control section which switches the output voltage of the high-frequency generating circuit from the level for heating to the preliminarily defined level for lighting in order to light the discharge lamp when the determination result of the second determining section becomes positive; and a lighting control section which changes the output voltage of the high frequency generating circuit from the level for starting to a preliminarily defined level for lighting in order to maintain lighting of the discharge lamp by the startup control section.

* * * * *